US010011446B2

(12) United States Patent
Iwasaki et al.

(10) Patent No.: US 10,011,446 B2
(45) Date of Patent: Jul. 3, 2018

(54) SHEET PAPER CONVEYOR DEVICE AND SHEET PAPER HANDLING DEVICE

(71) Applicant: Oki Electric Industry Co., Ltd., Tokyo (JP)

(72) Inventors: Satoru Iwasaki, Tokyo (JP); Atsushi Takada, Tokyo (JP); Madoka Wakabayashi, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 15/328,529

(22) PCT Filed: Jun. 19, 2015

(86) PCT No.: PCT/JP2015/067794

§ 371 (c)(1),
(2) Date: Jan. 24, 2017

(87) PCT Pub. No.: WO2016/035420

PCT Pub. Date: Mar. 10, 2016

(65) Prior Publication Data

US 2017/0206730 A1 Jul. 20, 2017

(30) Foreign Application Priority Data

Sep. 5, 2014 (JP) ..... 2014-181524

(51) Int. Cl.
*B65H 5/26* (2006.01)
*B65H 5/36* (2006.01)

(52) U.S. Cl.
CPC ..... *B65H 5/36* (2013.01); *B65H 5/26* (2013.01); *B65H 2701/1912* (2013.01)

(58) Field of Classification Search
CPC ..... B65H 5/36; B65H 29/58; B65H 31/24; B65H 2404/60; B65H 2404/61; B65H 2404/611; B65H 2404/63; B65H 2404/65
(Continued)

(56) References Cited

U.S. PATENT DOCUMENTS 6,279,901 B1 * 8/2001 Fulmer ..... B65H 15/00 271/186
6,286,828 B1 * 9/2001 Adema ..... B65G 47/252 198/404

(Continued)

FOREIGN PATENT DOCUMENTS

JP 2009-205252 A 9/2009
JP 2013-242608 A 12/2013

*Primary Examiner* — David H Bollinger
(74) *Attorney, Agent, or Firm* — Rabin & Berdo, P.C.

(57) ABSTRACT

A sheet paper conveyor includes pairs of conveyor guides that form a sheet paper conveyance path between guide surfaces which face each other with a predetermined conveyance path width between them and which are parallel to each other, and that are engaged with end portions of pairs of connection-side conveyor guides that form a conveyance path for the sheet paper using connection subject conveyance path guide surfaces that face each other with the conveyance path width between them and are parallel to each other, and with one end portions in a conveyance direction of the sheet paper. Supporting portions rotatably support the pairs of conveyor guides in accordance with positions of the pairs of connection-side conveyor guides such that the conveyance path width is maintained and such that the parallel state between the guide surfaces is maintained.

11 Claims, 20 Drawing Sheets

(58) Field of Classification Search
USPC ..... 271/186
See application file for complete search history.

(56) References Cited

U.S. PATENT DOCUMENTS

| | | | | |
|---|---|---|---|---|
| 6,296,246 | B1 * | 10/2001 | Boorsma | B65H 15/00 198/404 |
| 2009/0212493 | A1 | 8/2009 | Sugahara et al. | |
| 2013/0307210 | A1 | 11/2013 | Takada | |

* cited by examiner

SHEET PAPER CONVEYOR DEVICE AND SHEET PAPER HANDLING DEVICE

TECHNICAL FIELD

The present invention relates to a sheet paper conveyor device and a sheet paper handling device, and may be favorably applied, for example, to an automatic teller machine (ATM) that handles deposits and withdrawals of banknotes, and to a banknote conveyor unit that is provided in this automatic teller machine.

BACKGROUND ART

Current automatic teller machines have a structure in which a storage box loading case for loading a plurality of storage boxes that store banknotes is disposed on a lower side of an apparatus cabinet, and a distribution conveyor unit that distributes banknotes to the storage boxes is disposed on an upper side of this storage box loading case, and the storage box loading case and distribution conveyor unit are moved backwards and forwards relative to the apparatus cabinet so that banknotes can be withdrawn or deposited.

One automatic teller machine of this type is a machine in which a delivery conveyor unit that is formed by a banknote guides that rotate so as to follow any positioning discrepancies between the storage box loading case and the distribution conveyor unit is provided between the storage box loading case and the distribution conveyor unit. As a consequence, the storage box loading case and the distribution conveyor unit are connected together irrespective of any positioning discrepancies between the storage box loading case and the distribution conveyor unit, and banknotes can be conveyed (see, for example, Japanese Patent Application Laid-Open (JP-A) No. 2009-205252 (Patent Document 1))

SUMMARY OF THE INVENTION

Technical Problem

There is currently a need in this type of automatic teller machine for the conveyance paths of the storage box loading case and the distribution conveyor unit to be reliably connected together irrespective of any positioning discrepancies between the two, and for reliability to be improved by making the conveying of banknotes even more stable.

The present invention was conceived in consideration of the aforementioned drawbacks, and it is an object thereof to provide a sheet paper conveyor device and a sheet paper handling device that enable an improvement in reliability to be achieved.

Solution to the Problem

In order to solve the aforementioned drawbacks, in a sheet paper conveyor device according to the present invention, there are provided pairs of conveyor guides that form a sheet paper conveyance path between guide surfaces which face each other with a predetermined conveyance path width between them and which are parallel to each other, and that are engaged with end portions of pairs of connection-side conveyor guides that form a conveyance path for the sheet paper using connection subject conveyance path guide surfaces that face each other with the conveyance path width between them and are parallel to each other, and with one end portions in a conveyance direction of the sheet paper; and supporting portions that rotatably support the pairs of conveyor guides in accordance with positions of the pairs of connection-side conveyor guides such that the conveyance path width is maintained and such that the parallel state between the guide surfaces is maintained.

In this sheet paper conveyor device, even if pairs of conveyor guides are engaged at a tilted attitude with pairs of connection side conveyor guides because of positioning discrepancies when the connection subject conveyance path was positioned relative to the conveyance path, by connecting the conveyance path and the connection subject conveyance path together without changing the conveyance path width, it is possible to reliably prevent the conveyance path width of the conveyance path from becoming narrower than the width of the connection subject conveyance path, and to also reliably prevent step portions or recessed portions from being formed within the connecting portions.

In a sheet paper handling device according to the present invention there are provided pairs of connection-side conveyor guides that form a sheet paper conveyance path using connection subject conveyance path guide surfaces that face each other with a predetermined conveyance path width between them and are parallel to each other, pairs of conveyor guides that form a sheet paper conveyance path between guide surfaces which face each other with the conveyance path width between them and which are parallel to each other, and that are engaged with end portions of the pairs of connection-side conveyor guides, and with one end portions in a conveyance direction of the sheet paper, and supporting portions that rotatably support the pairs of conveyor guides in accordance with positions of the pairs of connection-side conveyor guides such that the conveyance path width is maintained and such that the parallel state between the guide surfaces is maintained.

In this sheet paper handling device, even if pairs of conveyor guides are engaged at a tilted attitude with pairs of connection side conveyor guides because of positioning discrepancies when the connection subject conveyance path was positioned relative to the conveyance path, by connecting the conveyance path and the connection subject conveyance path together without changing the conveyance path width, it is possible to reliably prevent the conveyance path width of the conveyance path from becoming narrower than the width of the connection subject conveyance path, and to also reliably prevent step portions or recessed portions from being formed within the connecting portions.

Advantageous Effects of the Invention

According to the present invention, even if pairs of conveyor guides are engaged at a tilted attitude with pairs of connection side conveyor guides because of positioning discrepancies when the connection subject conveyance path was positioned relative to the conveyance path, by connecting the conveyance path and the connection subject conveyance path together without changing the conveyance path width, it is possible to reliably prevent the conveyance path width of the conveyance path from becoming narrower than the width of the connection subject conveyance path, and to also reliably prevent step portions or recessed portions from being formed within the connecting portions. Therefore, the present invention makes it possible to obtain a sheet paper conveyor device and a sheet paper handling device that have improved reliability.

DESCRIPTION OF THE EMBODIMENTS

Hereinafter, exemplary embodiments for implementing the invention (referred to below as exemplary embodiments) will be described using the drawings.

1. First Exemplary Embodiment

1-1. Structure of an Automatic Teller Machine

Figure 1:
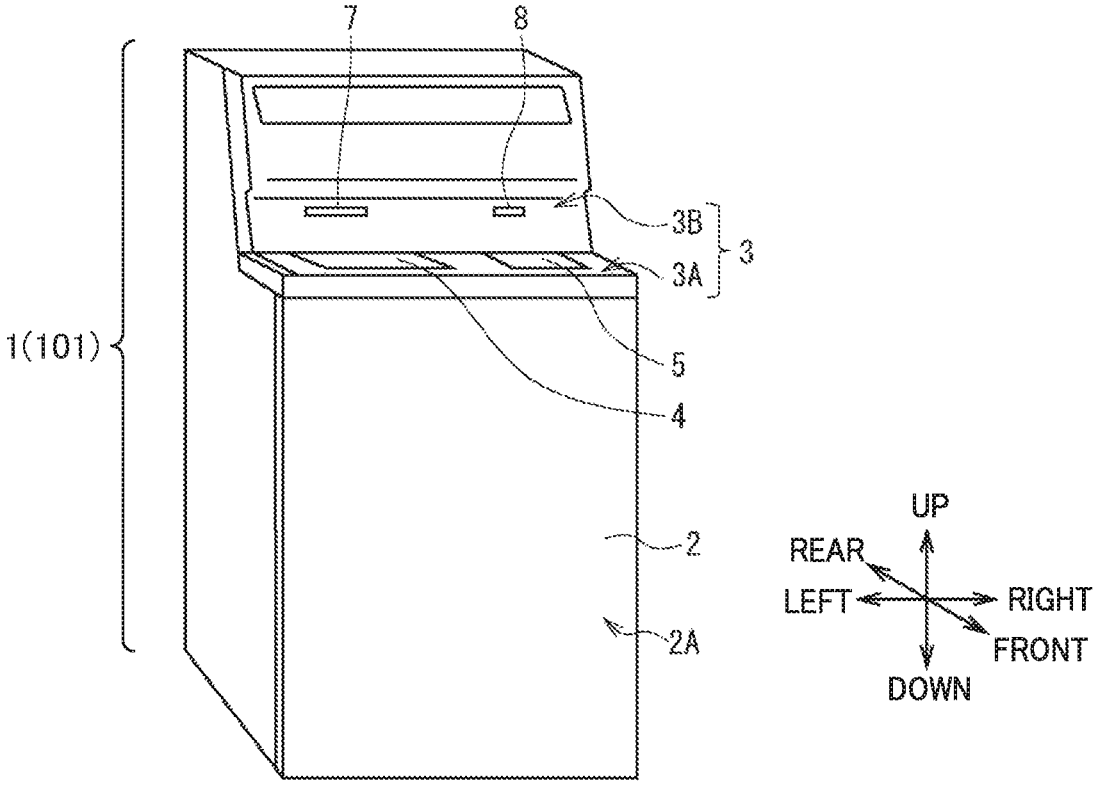
FIG. 1 is a perspective view showing an external structure of an automatic teller machine.

As can be seen from the external view shown in FIG. 1, the structure of an automatic teller machine 1 centers on a box-shaped apparatus cabinet 2, and this automatic teller machine 1 is installed, for example, in a financial institution or the like, and performs cash-related transactions with customers such as receiving deposits and issuing withdrawals. Hereinafter, a side of the automatic teller machine 1 facing a user will be referred to as a front side, while an opposite side from this is referred to as a rear side. In addition, left, right, up and down directions as seen by a user who is facing the aforementioned front side are referred to respectively as a left side, a right side, an upper side, and a lower side.

A front panel 3 that is formed substantially in an L shape that is indented towards the rear surface side from the front surface is provided in a front upper end portion the apparatus cabinet 2. An operation display screen 4 that is formed by integrating a liquid crystal display (LCD) that displays an operating screen during transactions together with a touch panel that is used to select the type of transaction and to input pin numbers and transactions amounts and the like is provided on the left-hand side of a substantially horizontal upward facing panel 3A that faces in an upward direction in the front panel 3. In addition, a banknote deposit and withdrawal unit 5 that is used for depositing or withdrawing rectangular banknotes is provided on the right-hand side of the upward facing panel 3A. A bankbook insertion and discharge aperture 7 that is used for inserting a bankbook during a transaction or to discharge the bankbook or a transaction statement is provided on the left-hand side of a substantially vertical forward facing panel 3B that faces in a forward direction in the front panel 3. In addition, a card insertion and discharge aperture 8 that is used for inserting or discharging various cards such as a cash card or credit card or the like during a transaction is provided on the right-hand side of the forward facing panel 3B.

Based on the above-described structure, the automatic teller machine 1 displays an operation display screen on the operation display unit 4, and switches the displayed operating screen appropriately in accordance with a touch operation performed on the surface of the operation display unit 4 by a customer. As a consequence, the automatic teller machine 1 guides a customer via the operation screen through a desired transaction procedure such as paying in money via a banknote deposit or paying out money via a banknote withdrawal. Accordingly, the automatic teller machine 1 enables a customer to insert their bankbook or card into the bankbook insertion and discharge aperture 7 or the card insertion and discharge aperture 8 following this guidance, or to pay banknotes for deposit into the banknote deposit and withdrawal unit 5. In addition, the automatic teller machine 1 enables a customer to receive back their bankbook, transaction statement or card discharged from the bankbook insertion and discharge aperture 7 or the card insertion and discharge aperture 8 following this guidance, or to receive banknotes paid out from the banknote deposit and withdrawal unit 5. In this way, the automatic teller machine 1 performs transactions desired by customers such as receiving or paying out banknotes.

1-2. Internal Structure of an Automatic Teller Machine

Figure 2:
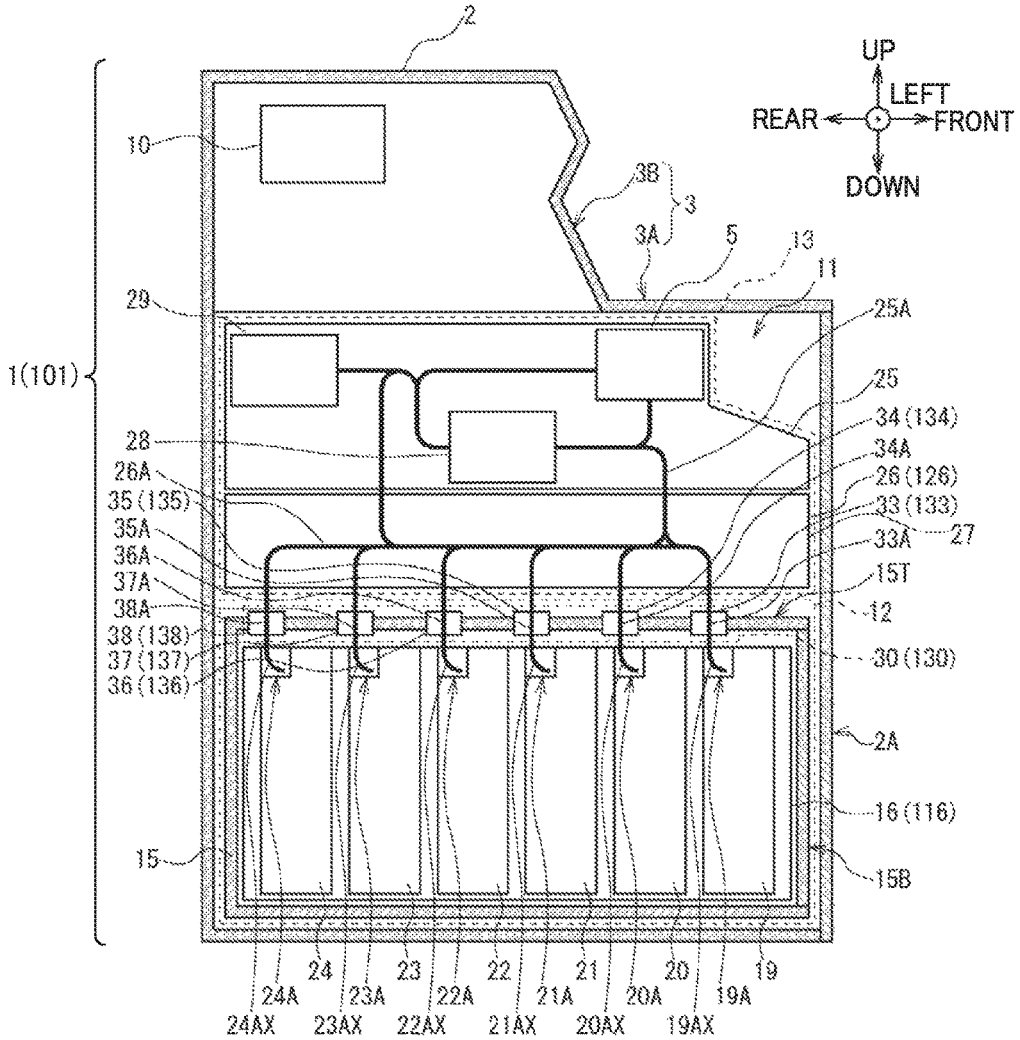
FIG. 2 is a left-side view showing an internal structure of an automatic teller machine.

As is shown in FIG. 2, a control unit 10 that performs integrated control for the entire automatic teller machine 1 is housed inside the apparatus cabinet 2 of the automatic teller machine 1. A banknote processor 11 that performs banknote deposit processing or banknote withdrawal processing or the like based on control performed by the control unit 10 is also housed inside the apparatus cabinet 2 of the automatic teller machine 1. The banknote processor 11 has a lower unit 12 and an upper unit 13, and the upper unit 13 is installed above the lower unit 12.

The lower unit 12 has a strongbox housing 15 that is formed substantially in a box shape by joining together a plurality of comparatively thick metal plates, and this strongbox housing 15 is fixed to the inside of the apparatus cabinet 2. In addition, a storage box loading case 16 that is formed substantially in the shape of a box having an open top end portion is housed inside the strongbox housing 15. The storage box loading case 16 is enclosed (see FIG. 4) by a right-side plate 16R, a left-side plate 16L, a rear plate 16B, a front plate 16F, and a bottom plate (not shown in the drawings), and a top surface thereof is left open. A plurality of partition plates (not shown in the drawings) are provided standing upright at predetermined intervals in sequence from the front towards the rear on a bottom surface of the storage box loading case 16. The bottom surface is partitioned by this plurality of partition plates into a plurality of storage box loading positions that run in sequence from the front towards the rear. Note that in FIG. 4 the left-side plate of the strongbox housing 15 has been omitted from the drawing. A reject box 19 that stores abnormal banknotes such as torn banknotes or creased banknotes is removably loaded in the frontmost storage box loading position in the storage box loading case 16. Furthermore, a plurality of (for example, five) banknote storage boxes 20 through 24 that store paid in or paid out banknotes respectively according to their denomination are removably loaded in the remaining plurality of storage box loading positions excluding the frontmost storage box loading position in the storage box loading case 16.

A storage box conveyor unit 19A having a plurality of types of conveyance path forming components such as conveyor guides and rollers and the like is provided integrally with the reject box 19 inside an upper end portion thereof. The plurality of types of conveyance path forming components are used in the storage box conveyor unit 19A to form a storage box conveyance path 19AX that conveys reject banknotes into the interior of the reject box 19.

Storage box conveyor units 20A through 24A having a plurality of different types of conveyance path forming components such as conveyor guides and rollers, and a roller drive motor, and the like are provided integrally with the banknote storage boxes 20 through 24 inside an upper end portion of each one. The plurality of types of conveyance path forming components are used in the storage box conveyor units 20A through 24A to form storage box conveyance paths 20AX through 24AX that convey banknotes into the interior of the banknote storage boxes 20 through 24, or pay out banknotes from the interior of the banknote storage boxes 20 through 24.

The upper unit 13 has an upper housing 25 and a distribution conveyor unit 26, and the distribution conveyor unit 26 is attached to a bottom surface of the upper housing 25.

The aforementioned banknote deposit and withdrawal unit 5 is disposed so as to face the upward facing panel 3A inside the upper housing 25. An assessment unit 28 is disposed to the rear and diagonally downward of the banknote deposit and withdrawal unit 5, and a temporary holding unit 29 is disposed on the rear side of the banknote deposit and withdrawal unit 5 and the assessment unit 28. Furthermore, an upper housing conveyance path 25A that connects a rear side of the assessment unit 28 to the banknote deposit and withdrawal unit 5 and the temporary holding unit 29, and also connects a front side of the assessment unit 28 to the banknote deposit and withdrawal unit 5 is provided inside the upper housing 25. The upper housing conveyance path 25A conveys rectangular banknotes in their short-side direction along a conveyance path shown by the bold lines in the drawing using rollers and belts and the like (not shown in the drawings).

Figure 4:
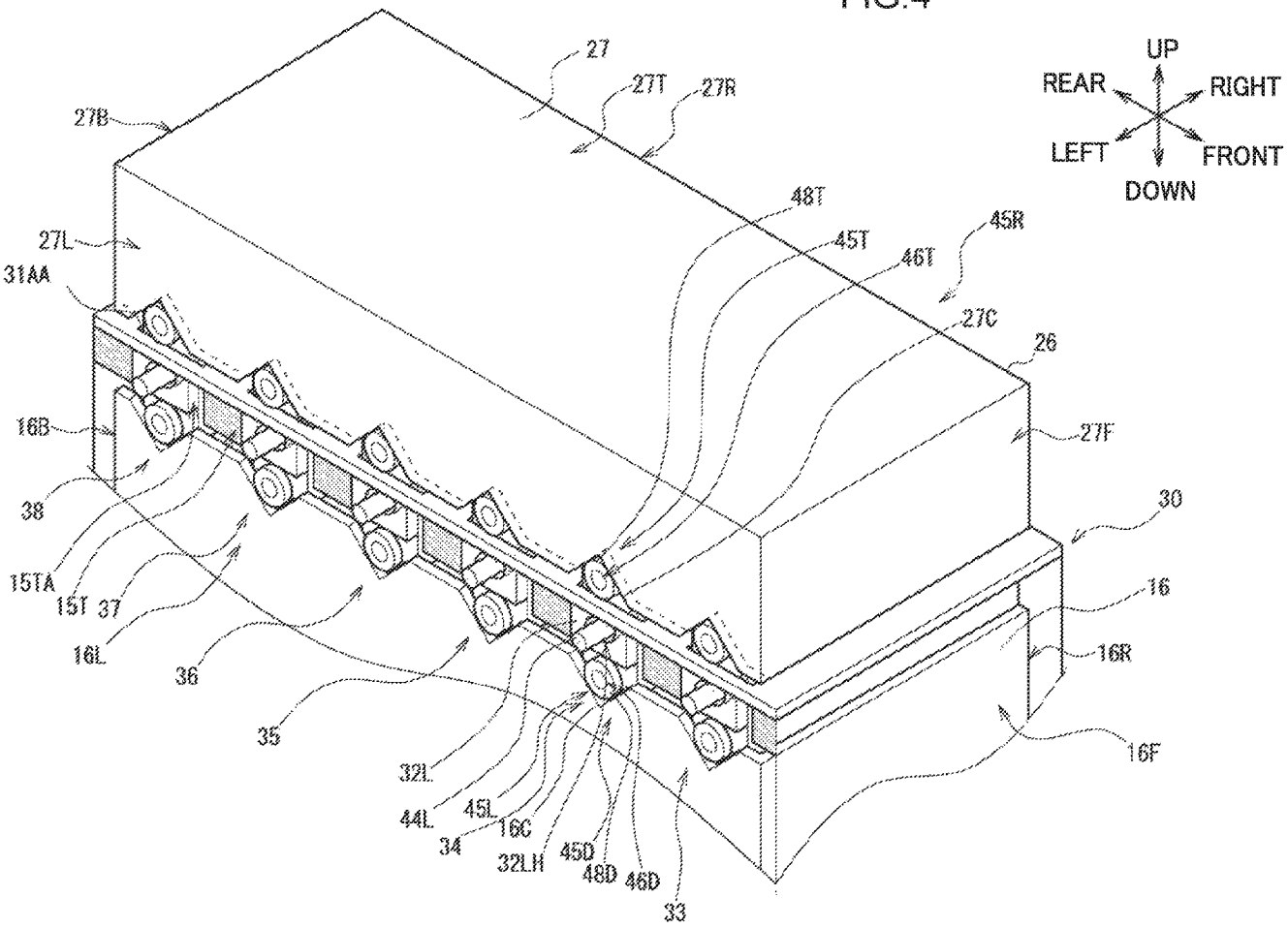
FIG. 4 is a perspective view showing the internal structure of the automatic teller machine according to the first exemplary embodiment.

As is shown in FIG. 4, the distribution conveyor unit 26 has a distribution conveyor unit housing 27 that is formed by a right-side plate 27R, a left-side plate 27L, a rear plate 27B, a front plate 27F, a top plate 27T, and a bottom plate (not shown in the drawings. A distribution conveyance path 26A that appropriately switches the conveyance destination so as to distribute and convey reject banknotes and normal banknotes respectively to the reject box 19 and the banknote storage boxes 20 through 24 is formed by a plurality of different types of conveyance path forming components in the distribution conveyor unit 26. An upper end portion of the distribution conveyance path 26A is connected in two locations to a lower end portion of the upper housing conveyance path 25A.

Figure 5:
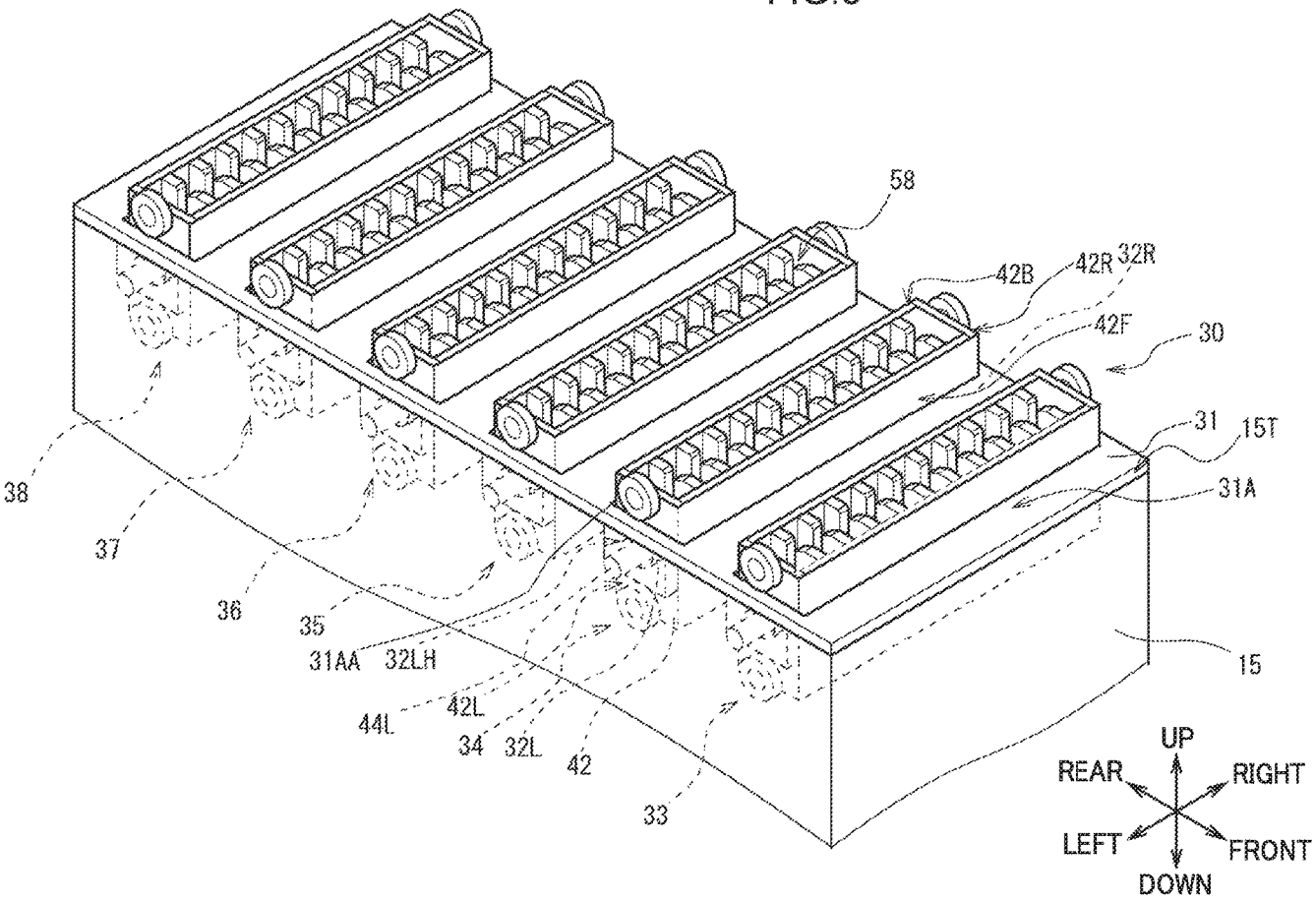
FIG. 5 is a perspective view showing a structure of a linking portion according to the first exemplary embodiment.
Figure 6A:
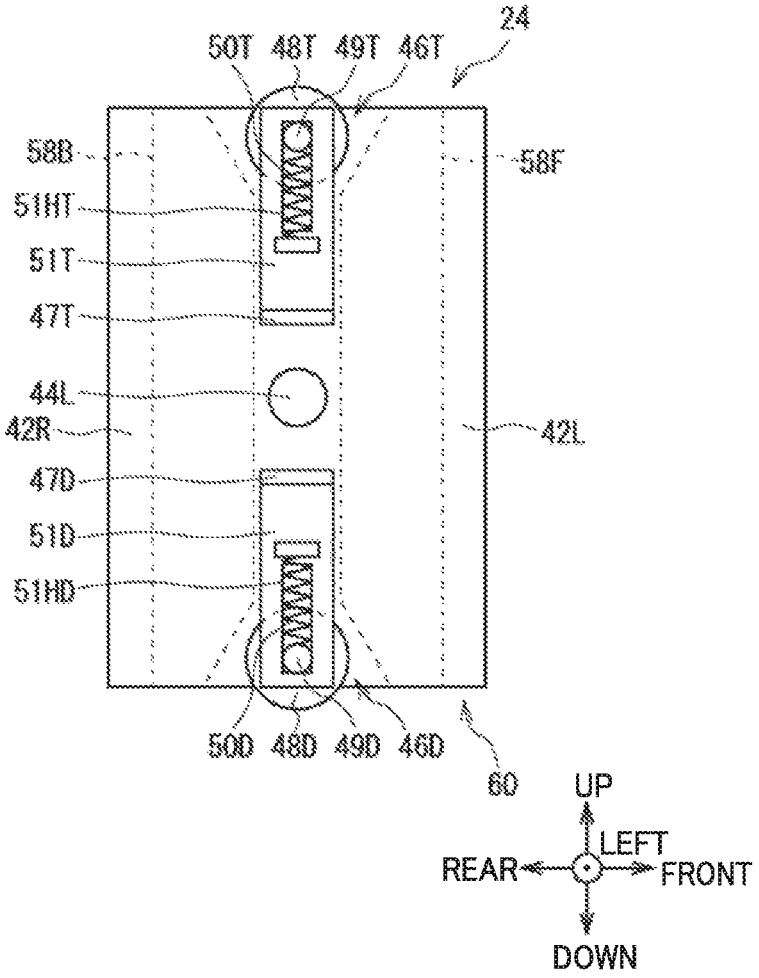
FIG. 6A is a left-side view showing a structure of a delivery conveyor unit according to the first exemplary embodiment.
Figure 6B:
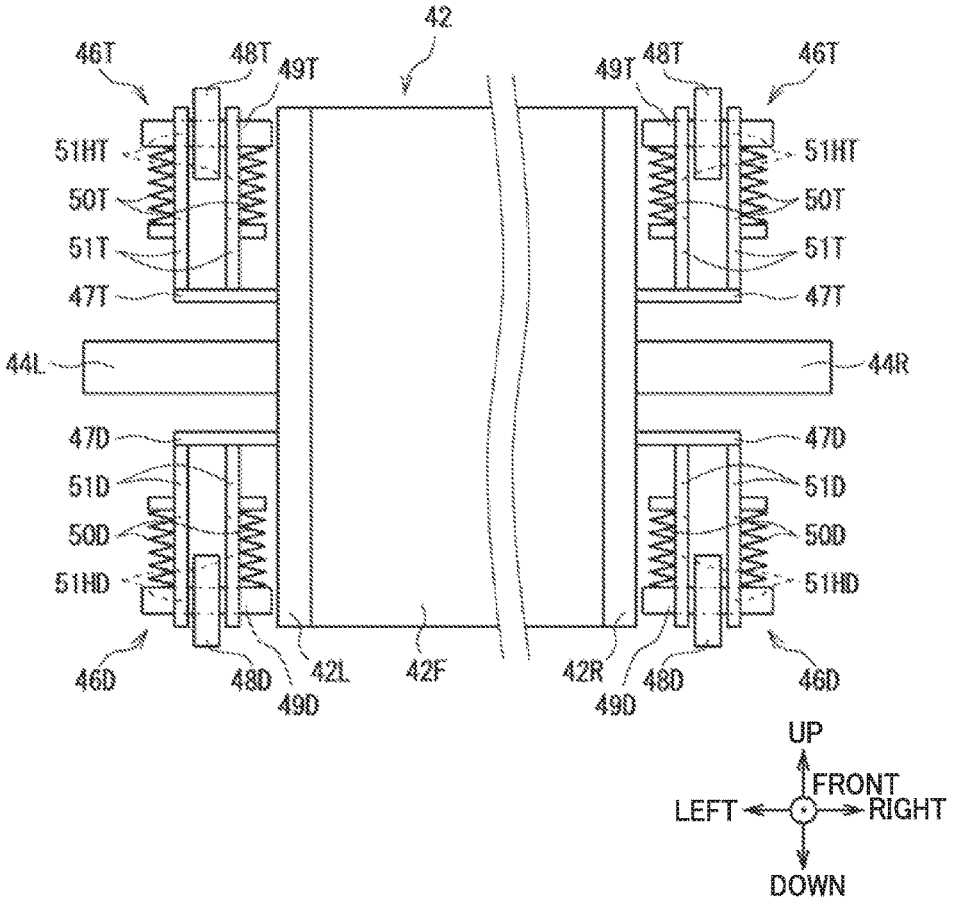
FIG. 6B is a frontal view showing the structure of the delivery conveyor unit according to the first exemplary embodiment.

A linking portion 30 that links together the distribution conveyor unit 26 and the storage box conveyor units 19A through 24A is provided in a strongbox top plate 15T, which is the top plate of the strongbox housing 15 in the lower unit 12. As is shown in FIG. 5, the linking portion 30 has a linking housing 31 that is formed so as to be substantially the same size as the size of the strongbox top plate 15T by, for example, working a single substantially rectangular metal plate. A substantially rectangular plate-shaped mounting portion 31A that is elongated in the front-rear direction is provided in a central portion of the linking housing 31.

Substantially rectangular linking hole portions 15TA that, as is shown in FIG. 4, are elongated in the left-right direction are cut in the strongbox top plate 15T of the strongbox housing 15 so as to correspond to the storage box conveyor units 19A through 24A. In addition, substantially rectangular mounting hole portions 31AA that are elongated in the left-right direction are cut in the mounting portion 31A of the linking housing 31 so as to correspond to the linking hole portions 15TA in the strongbox top plate 15T. As a consequence, the linking portion 30 is mounted onto the strongbox top plate 15T such that the mounting hole portions 31AA in the linking housing 31 match the linking hole portions 15TA in the strongbox top plate 15T.

Furthermore, the linking portion 30 also has delivery conveyor units 33 through 38 that respectively serve as sheet paper conveyor units and have a plurality of different types of conveyance path forming components such as conveyor guides and rollers and the like. In the linking portion 30, the delivery conveyor units 33 through 38 are mounted onto the linking housing 31 by being inserted one-by-one into the linking hole portions 15TA in the strongbox top plate 15T via the corresponding mounting hole portions 31AA.

A plate-shaped left-side bracket 32L and a plate-shaped right-side bracket 32R that each extend in parallel with a left-side plate 42L and a right-side plate 42R (described below) of the respective delivery conveyor units 33 through 38 are provided extending in a downward direction from left and right end surfaces of the mounting hole portions 31AA.

Here, a delivery conveyance path 33A (see FIG. 2) that conveys reject banknotes in one direction so as to deliver them from the distribution conveyance path 26A to the storage box conveyance path 19AX is formed by a plurality of different types of conveyance path forming components in the delivery conveyor unit 33 that is inserted into linking hole portion 15TA in the strongbox top plate 15T. An upper end portion of the delivery conveyance path 33A is connected to the frontmost lower end portion to which it corresponds from among the plurality of lower end portions of the distribution conveyance path 26A. A lower end portion of the delivery conveyance path 33A is connected to an upper end portion of the storage box conveyance path 19AX.

In addition, delivery conveyance paths 34A through 38A (see FIG. 2) that convey banknotes in two directions so as to either deliver them from the distribution conveyance path 26A to the corresponding storage box conveyance path from among the storage box conveyance paths 20AX through 24AX, or else deliver them from the corresponding storage box conveyance path from among the storage box conveyance paths 20AX through 24AX to the distribution conveyance path 26A are formed respectively by a plurality of different types of conveyance path forming components in the delivery conveyor units 34 through 38 that are inserted into the linking hole portions 15TA in the strongbox top plate 15T. An upper end portion of each of the delivery conveyance paths 34A through 38A is connected to the corresponding lower end portion of the distribution conveyance path 26A. Moreover, a lower end portion of each of the delivery conveyance paths 34A through 38A is connected to an upper end portion of the corresponding storage box conveyance path from among the storage box conveyance paths 20AX through 24AX.

In this structure, when the automatic teller machine 1 is performing banknote deposit processing, when banknotes to be deposited are placed by a customer in the banknote deposit and withdrawal unit 5, the banknotes are fed forward one-by-one from the banknote deposit and withdrawal unit 5 via the upper housing conveyance path 25A, and are conveyed to the assessment unit 28. In the assessment unit 28, the denomination and the condition and the like of these banknotes are assessed. Banknotes that have been assessed as normal and have been fed forward from the assessment unit 28 are conveyed via the upper housing conveyance path 25A to the temporary holding unit 29 where they are temporarily held, and the automatic teller machine 1 retains these deposited banknotes. On the other hand, banknotes that, because of tears or creases or the like, have been assessed as abnormal by the assessment unit 28 and have been fed forward are conveyed as reject banknotes via the upper housing conveyance path 25A to the banknote deposit and withdrawal unit 5, and the automatic teller machine 1 then returns these reject banknotes to the customer by enabling the customer to retrieve them from the banknote deposit and withdrawal unit 5.

When all of the banknotes to be deposited that have been placed in the banknote deposit and withdrawal unit 5 have been assessed by the assessment unit 28, the automatic teller machine 1 presents the total amount of the banknotes assessed as normal (namely, the total deposit amount) to the customer via the operation display unit 4. When, as a result of this, the customer confirms the total deposit amount and gives a command via the operation display unit 4 for these banknotes to be deposited, the automatic teller machine 1 feeds the banknotes being held temporarily forward from the temporary holding unit 29, and conveys them one-by-one to the assessment unit 28 via the upper housing conveyance path 25A. In the assessment unit 28, the denomination and condition and the like of these banknotes are once again assessed. Banknotes that have been assessed as normal and have been fed forward from the assessment unit 28 are conveyed by the automatic teller machine 1 via the upper housing conveyance path 25A, the distribution conveyance path 26A, and the delivery conveyance paths 34A through 38A in that sequence to the relevant banknote storage box from among the banknote storage boxes 20 through 24 in accordance with the denomination of each banknote, and the banknotes are stored inside the banknote storage boxes 20 through 24 via the storage box conveyance paths 20AX through 24AX. At this time, banknotes that have been assessed as abnormal and have been fed forward from the assessment unit 28 are conveyed by the automatic teller machine 1 via the upper housing conveyance path 25A, the distribution conveyance path 26A, and the delivery conveyance path 33A in that sequence to the reject box 19 as reject banknotes, and are stored inside the reject box 19 via the storage box conveyance path 19AX.

On the other hand, in the case of banknote withdrawal processing, when an amount to be withdrawn is specified by a customer via the operation display unit 4, the automatic teller machine 1 feeds out banknotes one-by-one corresponding to the total amount specified by that customer from inside the banknote storage boxes 20 through 24 via the storage box conveyance paths 20AX through 24AX. The automatic teller machine 1 conveys the banknotes fed out one-by-one from the banknote storage boxes 20 through 24 to the assessment unit 28 via the delivery conveyance paths 34A through 38A, the distribution conveyance path 26A, and the upper housing conveyance path 25A in that sequence, and causes the assessment unit 28 to assess the denomination and condition and the like of the banknotes. Banknotes that have been assessed as normal and have been fed forward from the assessment unit 28 are conveyed by the automatic teller machine 1 to the banknote deposit and withdrawal unit 5 via the upper housing conveyance path 25A. In contrast, banknotes that have been assessed as abnormal and have been fed forward from the assessment unit 28 are conveyed by the automatic teller machine 1 via the upper housing conveyance path 25A, the distribution conveyance path 26A, and the delivery conveyance path 33A in that sequence to the reject box 19 as reject banknotes, and are stored inside the reject box 19 via the storage box conveyance path 19AX. These abnormal banknotes are not used in any subsequent payment processing. When the conveying of the banknotes corresponding to the total amount specified for withdrawal to the banknote deposit and withdrawal unit 5 has been completed, the automatic teller machine 1 presents the banknotes corresponding to the total amount specified for withdrawal such that they are ready for removal from the banknote deposit and withdrawal unit 5 by the customer.

An apparatus cabinet front door 2A that covers a front surface of the apparatus cabinet 2 is provided such that it can be opened and closed via a hinge portion (not shown in the drawings). Furthermore, in the strongbox housing 15, the metal plate forming the front plate out of the plurality of metal plates forming the strongbox housing 15 serves as a strongbox housing front door 15B, and is provided such that it can be opened and closed via a hinge portion (not shown in the drawings).

Figure 3:
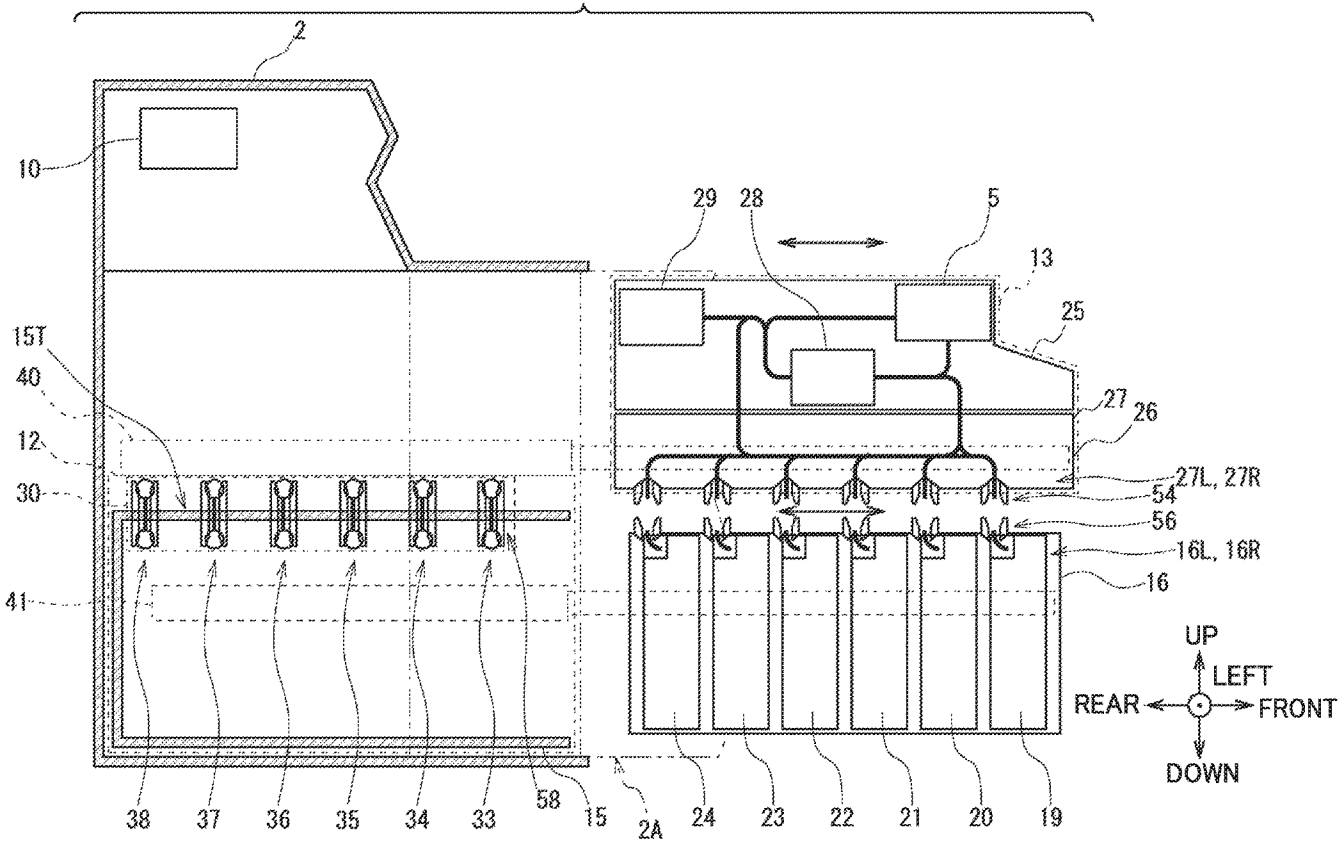
FIG. 3 is a left-side view showing a structure of an automatic teller machine when an upper unit and a storage box loading case according to a first exemplary embodiment have been pulled out.

As is shown in FIG. 3, the upper unit 13 is mounted on the apparatus cabinet 2 via upper-side slide rails 40. The upper-side slide rails 40 are formed by assembling together rail-shaped components that extend in the front-rear direction, and a plurality of rollers and the like (not shown in the drawings), and enable the upper unit 13 to slide both rectilinearly and smoothly towards the front and towards the rear relative to the apparatus cabinet 2.

In the automatic teller machine 1, when transaction processing is being performed with a customer, or when maintenance work is not being carried out, as is shown in FIG. 2, by housing the upper unit 13 inside the apparatus cabinet 2, each section of the upper unit 13 as well the banknotes and the like are protected. Hereinafter, this state is called an upper unit storage state. On the other hand, in the automatic teller machine 1, when maintenance work is being carried out by a maintenance worker, as is shown in FIG. 3, the apparatus cabinet front door 2A is opened, the upper unit 13 is moved forwards (i.e., in a pull-out direction), and the upper unit 13 is placed on the outside of the apparatus cabinet 2 in a pulled out state. Hereinafter, this state is called an upper unit pull-out state.

The storage box loading case 16 is mounted in the strongbox housing 15 via lower-side slide rails 41. The lower-side slide rails 41 are formed by assembling together rail-shaped components that extend in the front-rear direction, and a plurality of rollers and the like (not shown in the drawings), and enable the storage box loading case 16 to slide both rectilinearly and smoothly towards the front and towards the rear relative to the strongbox housing 15.

In the automatic teller machine 1, when transaction processing is being performed with a customer, or when maintenance work is not being carried out, as is shown in FIG. 2, by housing the storage box loading case 16 inside the strongbox housing 15, each section of the storage box loading case 16 as well the banknotes and the like are protected. Hereinafter, this state is called a storage box loading case storage state. On the other hand, in the automatic teller machine 1, when maintenance work is being carried out by a maintenance worker, as is shown in FIG. 3, the apparatus cabinet front door 2A and the strongbox housing front door 15B (not shown in the drawings) are opened, the storage box loading case 16 is moved forwards (i.e., in a pull-out direction), and the storage box loading case 16 is placed on the outside of the apparatus cabinet 2 in a pulled out state. Hereinafter, this state is called a storage box loading case pull-out state. Note that FIG. 3 shows both an upper unit pull-out state and a storage box loading case pull-out state.

In the automatic teller machine 1, at the outside of the strongbox housing 15 (i.e., at the front of the apparatus cabinet 2), a maintenance worker pulls the banknote storage boxes 20 through 24 out from the storage box loading case 16 when the banknotes stored therein drop below a prescribed number or have all been paid out. The maintenance worker also loads the banknote storage boxes 20 through 24 back into the storage box loading case 16 once they have been replenished with a plurality of banknotes.

Here, as is shown in FIG. 3, in the linking portion 30, a movable guide 58, which is a conveyance path connecting portion that is connected to the distribution conveyor unit 26, is made to protrude on the upper side of the strongbox top plate 15T in the delivery conveyor units 33 through 38. Moreover, in the distribution conveyor unit housing 27, distribution conveyor unit fixed guides 54, which are conveyance path connecting portions that connect to the delivery conveyor units 33 through 38 in the distribution conveyor unit 26, are made to protrude downwards beyond horizontally extending bottom ends of the right-side plate 27R and the left-side plate 27L. Accordingly, in the linking portion 30, in the upper unit storage state, the conveyance path connecting portions of the distribution conveyor unit 26 are positioned above the corresponding delivery conveyor unit out of the delivery conveyor units 33 through 38. As a consequence, in the linking portion 30, upper end portions of the delivery conveyance paths 33A through 38A are connected respectively to the corresponding lower end portion of the distribution conveyance path 26A.

In addition, when the upper unit 13 has been pulled out from the apparatus cabinet 2, by moving the distribution conveyor unit 26 towards the front from above the delivery conveyance units 33 through 38, the lower end portions of the distribution conveyance path 26A are all detached from the corresponding upper end portion of the delivery conveyance paths 33A through 38A. Moreover, in the linking portion 30, when the upper unit 13 is moved towards the rear (i.e., in a storage direction) so as to rehouse the upper unit 13 inside the apparatus cabinet 2, the conveyance path connecting portions of the distribution conveyor unit 26 are once again positioned above the corresponding delivery conveyance units 33 through 38. As a consequence, in the linking portion 30, the upper end portions of the delivery conveyance paths 33A through 38A are once again connected respectively to the corresponding lower end portion of the distribution conveyance path 26A. Hereinafter, the pull-out direction and the storage direction are collectively referred to as the slide direction.

On the other hand, in the linking portion 30, the movable guide 58, which is a conveyance path connecting portion in the delivery conveyor units 33 through 38 that connects to the storage box conveyor units 19A through 24A through 38, is made to protrude onto the underside of the metal top plate 15T (namely, into the interior of the strong box housing 15). Moreover, in the storage box loading case 16, storage box fixed guides 56, which are conveyance path connecting portions that connect to the delivery conveyor units 33 through 38 in the storage box conveyor units 19A through 24A, are made to protrude upwards beyond horizontally extending top ends of the right-side plate 16R and the left-side plate 16L. Accordingly, in the linking portion 30, in the storage box loading case storage state, the conveyance path connecting portions of the storage box conveyor units 19A through 24A are positioned below the corresponding delivery conveyor unit 33 through 38. As a consequence, in the linking portion 30, lower end portions of the delivery conveyance paths 33A through 38A are connected to the corresponding upper end portion of the storage box conveyance paths 19AX through 24AX.

In addition, when the storage box loading case 16 has been pulled out from the strongbox housing 15, by moving the reject box 19 and the banknote storage boxes 20 through 24 towards the front from underneath the delivery conveyor units 33 through 38, the upper end portions of the storage box conveyance paths 19AX through 24AX are all detached from the corresponding lower end portions of the delivery conveyance paths 33A through 38A. Moreover, in the linking portion 30, when the storage box loading case 16 is moved towards the rear (i.e., in a storage direction) so as to rehouse the storage box loading case 16 inside the strongbox housing 15, the conveyance path connecting portions of the storage box conveyor units 19A through 24A are once again positioned underneath the corresponding delivery conveyor units 33 through 38. As a consequence, in the linking portion 30, the lower end portions of the delivery conveyance paths 33A through 38A are once again connected respectively to the upper end portions of the corresponding storage box conveyance paths 19AX through 24AX.

1-3. Structure of the Linking Portion

As was described above with reference to FIG. 5, in the linking portion 30, the delivery conveyor units 33 through 38 are mounted on the linking housing 31 in that sequence moving towards the rear. Because the delivery conveyor units 33 through 38 basically have the same structure, hereinafter, only the structure of the delivery conveyor unit 34 will be described.

Figure 7A:
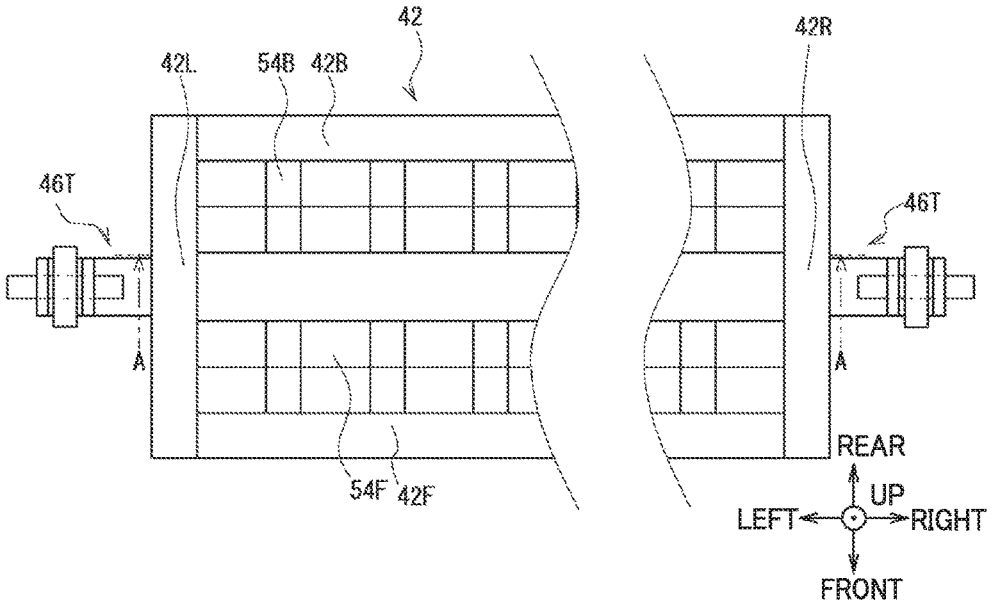
FIG. 7A is a plan view showing the structure of the delivery conveyor unit according to the first exemplary embodiment.
Figure 7B:
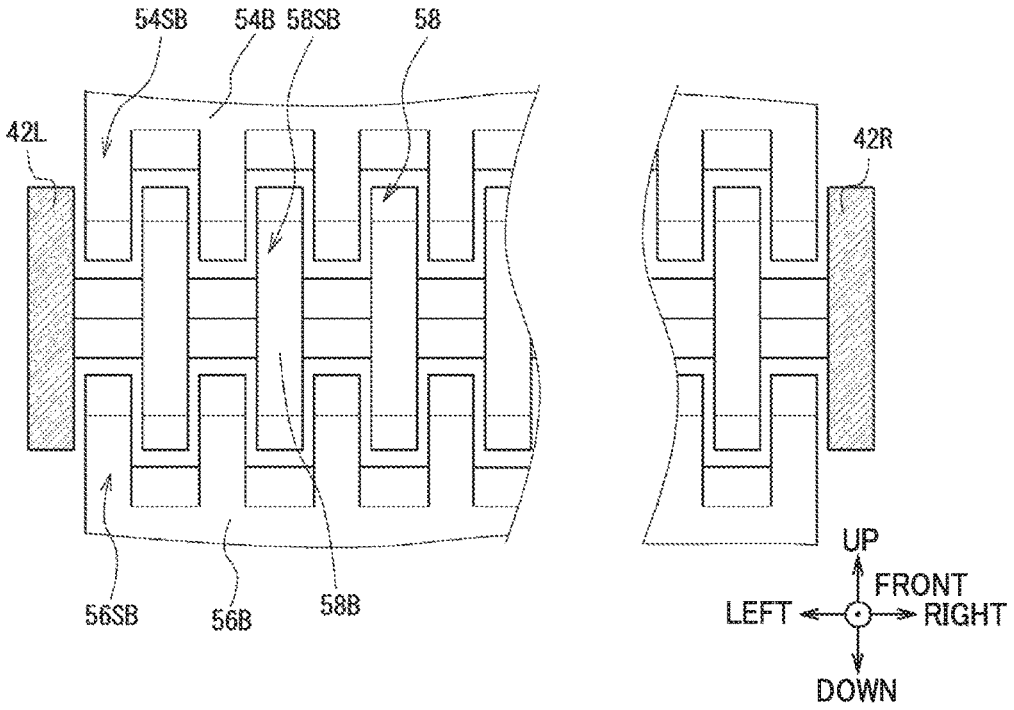
FIG. 7B is a cross-sectional view taken along a line A-A in FIG. 7A showing the structure of the delivery conveyor unit according to the first exemplary embodiment.

As is shown in FIG. 5 and in FIGS. 7A and 7B, a delivery conveyor unit housing 42 is provided in the delivery conveyor unit 34. The delivery conveyor unit housing 42 is formed by assembling together the left-side plate 42L, the right-side plate 42R, a rear-side plate 42B, and a front-side plate 42F, which are all flat, metal plates, and, as a consequence, is provided with an internal space. In the delivery conveyor unit housing 42, the length in the left-right direction of the front-side plate 42F and the rear-side plate 42B is formed longer than the length of a longitudinal direction, which is orthogonal to the conveyance direction, of the banknotes, and is formed shorter than the length in the left-right direction of the mounting hole portions 31AA. Furthermore, in the delivery conveyor unit housing 42, the length in the front-rear direction of the right-side plate 42R and the left-side plate 42L is formed shorter than the length in the front-rear direction of the mounting hole portions 31AA.

Figure 8:
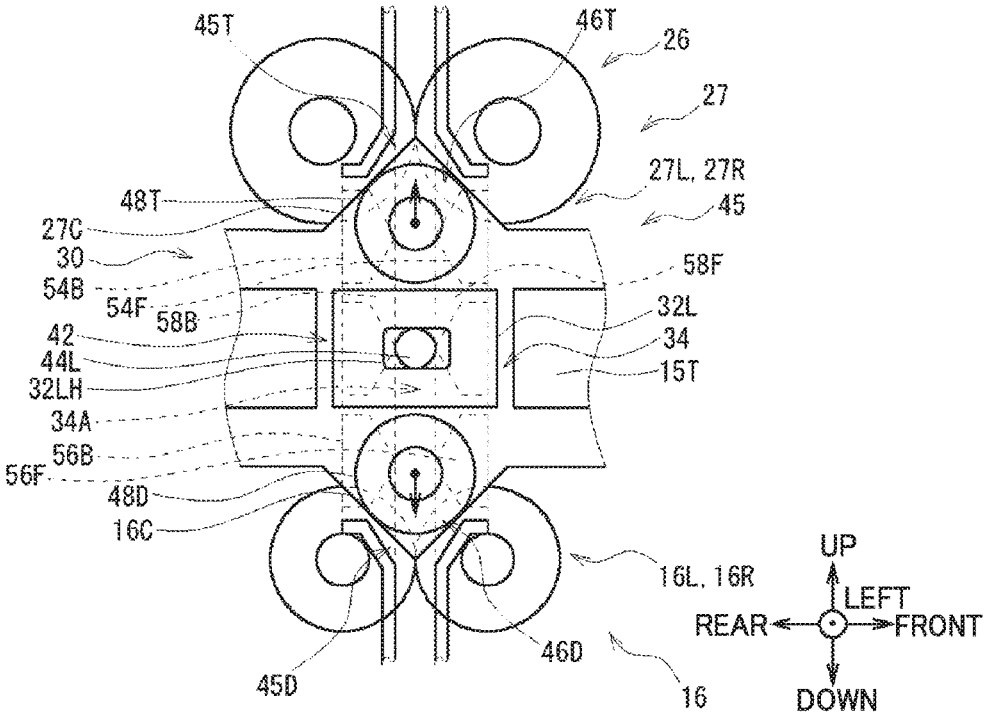
FIG. 8 is a left-side view showing a structure (1) of a positioning portion according to the first exemplary embodiment.

A circular cylinder-shaped delivery conveyor unit housing left-side shaft 44L protrudes towards the left side from the left-side plate 42L, and is inserted through a left-side bracket hole portion 32LH that has been formed in the left-side bracket 32L. Moreover, a circular cylinder-shaped delivery conveyor unit housing right-side shaft 44R protrudes towards the right side along an extension line of the delivery conveyor unit housing left-side shaft 44L from the right-side plate 42R, and is inserted through a right-side bracket hole portion 32RH (not shown in the drawings) that has been formed in the right-side bracket 32R. Hereinafter, the delivery conveyor unit housing left-side shaft 44L and the delivery conveyor unit housing right-side shaft 44R are collectively referred to as a delivery conveyor unit housing shaft 44. A movable guide supporting portion 60 that supports the movable guide 58 is formed by the delivery conveyor unit housing shaft 44 and the delivery conveyor unit housing 42. As is shown in FIG. 8, the left-side bracket hole portion 32LH is formed having substantially the same height in the up-down direction as the delivery conveyor unit housing left-side shaft 44L, while the width in the front-rear direction of the left-side bracket hole portion 32LH is formed wider than the delivery conveyor unit housing left-side shaft 44L. The right-side bracket hole portion 32RH (not shown in the drawings) is formed having substantially the same height in the up-down direction as the delivery conveyor unit housing right-side shaft 44R, while the width in the front-rear direction of the right-side bracket hole portion 32RH is formed wider than the delivery conveyor unit housing right-side shaft 44R. As a consequence, the left-side bracket 32L and the right-side bracket 32R support the delivery conveyor unit housing left-side shaft 44L and the delivery conveyor unit housing right-side shaft 44R such that movement in the up-down direction thereof is restricted while, at the same time, movement thereof in the front-rear direction is allowed, and such that they are able to rotate freely in parallel with the left-right direction both clockwise and counter-clockwise when seen in left and right side views inside both the left-side bracket hole portion 32LH and the right-side bracket hole portion 32RH.

A left-side positioning portion 45L and a right-side positioning portion 45R that position the distribution conveyor unit 26 (i.e., the upper unit 13) and the storage box loading case 16 relative to the delivery conveyor unit 34 are provided respectively at a left end portion and a right end portion, which are end portions in an orthogonal direction relative to the slide direction, of the delivery conveyor unit 34 (see FIG. 4). Because the left-side positioning portion 45L and the right-side positioning portion 45R are formed substantially the same, hereinafter, principally the left-side positioning portion 45L will be described. The left-side positioning portion 45L is formed by an upper-side positioning portion 45T that serves as a positioning component that positions the distribution conveyor unit 26 (i.e., the upper unit 13) relative to the delivery conveyor unit 34, and a lower-side positioning portion 45D that serves as a positioning component that positions the storage box loading case 16 relative to the delivery conveyor unit 34. The upper-side positioning portion 45T is formed by an upper-side urging portion 46T of the delivery conveyor unit 34, and a distribution conveyor unit housing recess 27C of the distribution conveyor unit housing 27, while the lower-side positioning portion 45D is formed by a lower-side urging portion 46D of the delivery conveyor unit 34, and a storage box loading case recess 16C of the storage box loading case 16.

As is shown in FIG. 6A, FIG. 6B, FIG. 7A, and FIG. 7B, the upper-side urging portion 46T is formed by an upper-side supporting portion 47T, an upper-side positioning roller 48T, an upper-side positioning roller shaft 49T, and upper-side springs 50T. The plate-shaped upper-side supporting portion 47T protrudes towards the left side from the left-side plate 42L, and shaft supporting plates 51T are provided standing upright at a distance from each other in the left-right direction at a left end portion of the upper-side supporting portion 47T. An upper-side supporting portion hole 51HT that is elongated in an extending direction (i.e., in the up-down direction) is formed in each shaft supporting plate 51T. By inserting the upper-side positioning roller shaft 49T through the upper-side supporting portion holes 51HT, and sliding the upper-side positioning roller shaft 49T in the up-down direction inside the upper-side supporting portion holes 51HT, the upper-side positioning roller 48T is able to be moved in directions in which it approaches or moves away from the distribution conveyor unit housing 27, and is also able to rotate freely when seen in a side view around the upper-side positioning roller shaft 49T. An upper end of each upper-side spring 50T, which are compression springs, is attached to the left or right end portions of the upper-side positioning roller shaft 49T, and a lower end of the upper-side springs 50T is attached to the shaft supporting plates 51T while the upper-side springs 50T are compressed beyond their natural state. As a result of this, because of the repulsive force that attempts to open up the upper-side springs 50T from their compressed state and restore them to their natural state, the upper-side springs 50T urge the upper-side positioning roller shaft 49T and the upper-side positioning roller 48T upwards towards the distribution conveyor unit housing 27. Because the lower-side urging portion 46D is formed so as to be in point symmetry with the upper-side urging portion 46T centering around the delivery conveyor unit housing left-side shaft 44L, a description thereof will be omitted. The lower-side positioning roller 48D is urged by lower-side springs 50D upwards towards the storage box loading case 16 and, at the same time as this, the lower-side positioning roller shaft 49D slides inside lower-side supporting portion holes 51HD that have been formed in shaft supporting plates 51D that are provided standing upright from the lower-side supporting portion 47D. As a consequence, the lower-side positioning roller 48D is able to be moved in directions in which it approaches or moves away from the storage box loading case 16, and is also able to rotate freely when seen in a side view around the lower-side positioning roller shaft 49D.

In the upper unit storage state, the distribution conveyor unit housing recesses 27C are formed in locations of a lower end surface of the left-side plate 27L and the right-side plate 27R of the distribution conveyor unit housing 27 (see FIG. 8) where they face the upper-side positioning rollers 48T. When seen in a side view, the distribution conveyor unit housing recesses 27C are triangular-shaped notches into which the upper-side positioning rollers 48T are fitted. Furthermore, in the storage box loading case storage state, the storage box loading case recesses 16C are formed in locations of an upper end surface of the left-side plate 16L and the right-side plate 16R of the storage box loading case 16 where they face the lower-side positioning roller s48D. When seen in a side view, the storage box loading case recesses 16C are triangular-shaped notches into which the lower-side positioning rollers 48D are fitted.

In the delivery conveyor unit 34, as a result of the upper-side positioning roller 48T being pressed against the lower end surface of the distribution conveyor unit housing recesses 27C, the distribution conveyor unit 26 (i.e., the upper unit 13) is positioned relative to the delivery conveyor unit 34. Also in the delivery conveyor unit 34, as a result of the lower side positioning roller 48D being pressed against the upper end surface of the storage box loading case recesses 16C, the storage box loading case 16 is positioned relative to the delivery conveyor unit 34.

Furthermore, in the delivery conveyor unit 34, when the upper-side positioning roller 48T has been fitted into the distribution conveyor unit housing recesses 27C, if a predetermined force or greater is applied in the slide direction to the upper unit 13, then by compressing the upper-side springs 50T and causing the upper-side positioning roller 48T to move in a direction in which it separates from the distribution conveyor unit housing 27, the upper-side positioning roller 48T is removed from the distribution conveyor unit housing recesses 27C, and is pressed against the lower end surfaces of the left-side plate 27L and the right-side plate 27R. Furthermore, in the delivery conveyor unit 34, when the lower-side positioning roller 48D has been fitted into the storage box loading case recesses 16C, if a predetermined force or greater is applied in the slide direction to the storage box loading case 16, then by compressing the lower-side springs 50D and causing the lower-side positioning roller 48D to move in a direction in which it separates from the storage box loading case 16, the lower-side positioning roller 48D is removed from the storage box loading case recesses 16C, and is pressed against the upper end surfaces of the left-side plate 16L and the right-side plate 16R.

In this way, in the linking portion 30 (see FIG. 4), by engaging the upper-side positioning rollers 48T of each one of the delivery conveyor units 33 through 38 in the corresponding distribution conveyor unit housing recesses 27C, in the upper unit storage state, the distribution conveyor unit 26 (i.e., the upper unit 13) is positioned relative to the linking portion 30. Moreover, in the linking portion 30, by engaging the lower-side positioning rollers 48D of each one of the delivery conveyor units 33 through 38 in the corresponding storage box loading case recesses 16C, in the storage box loading case storage state, the storage box loading case 16 is positioned relative to the linking portion 30.

Here, the repulsive force of the upper-side springs 50T, the diameter of the upper-side positioning roller 48T, the angle of the notches of the distribution conveyor unit housing recesses 27C relative to the lower end surface of the left-side plate 27L and the right-side plate 27R, and the size of these notches are set such that the upper-side positioning roller 48T can be removed from the distribution conveyor unit housing recesses 27C by the force applied by a maintenance worker to move the upper unit 13. In addition, the repulsive force of the lower-side springs 50D, the diameter of the lower-side positioning roller 48D, the angle of the notches of the storage box loading case recesses 16C relative to the upper end surface of the left-side plate 16L and the right-side plate 16R, and the size of these notches are set such that the lower-side positioning roller 48D can be removed from the storage box loading case recesses 16C by the force applied by a maintenance worker to move the storage box loading case 16.

On the other hand, in the linking portion 30, if a predetermined force or greater is applied to the distribution conveyor unit 26 in the pull-out direction, which is one of the two possible directions of movement, when the distribution conveyor unit 26 (i.e., the upper unit 13) has been positioned in the linking portion 30, the distribution conveyor unit 26 (i.e., the upper unit 13) is made to slide in the pull-out direction relative to the linking portion 30, and is placed in the upper unit pull-out state. In addition, in the linking portion 30, if a predetermined force or greater is applied to the storage box loading case 16 when the storage box loading case 16 has been positioned in the linking portion 30, the storage box loading case 16 is made to slide in the pull-out direction relative to the linking portion 30, and is placed in the storage box loading case pull-out state.

In contrast, in the linking portion 30, if a predetermined force or greater is applied to the distribution conveyor unit 26 (i.e., the upper unit 13) in the storage direction, which is the other of the two possible directions of movement, when the distribution conveyor unit 26 has been placed in the upper unit pull-out state, the distribution conveyor unit 26 (i.e., the upper unit 13) is made to slide in the storage direction relative to the linking portion 30, and by then engaging the upper-side positioning rollers 48T of each one of the delivery conveyor units 33 through 38 in the corresponding distribution conveyor unit housing recesses 27C, the distribution conveyor unit 26 (i.e., the upper unit 13) is placed in the upper unit storage state. In the same way, in the linking portion 30, if a predetermined force or greater is applied to the storage box loading case 16 in the storage direction in the storage box loading case pull-out state, the storage box loading case 16 is made to slide in the storage direction relative to the linking portion 30, and by then engaging the lower-side positioning rollers 48D of each one of the delivery conveyor units 33 through 38 in the corresponding storage box loading case recesses 16C, the storage box loading case 16 is placed in the storage box loading case storage state.

1-4. Structure of the Delivery Conveyor Unit

Figure 9:
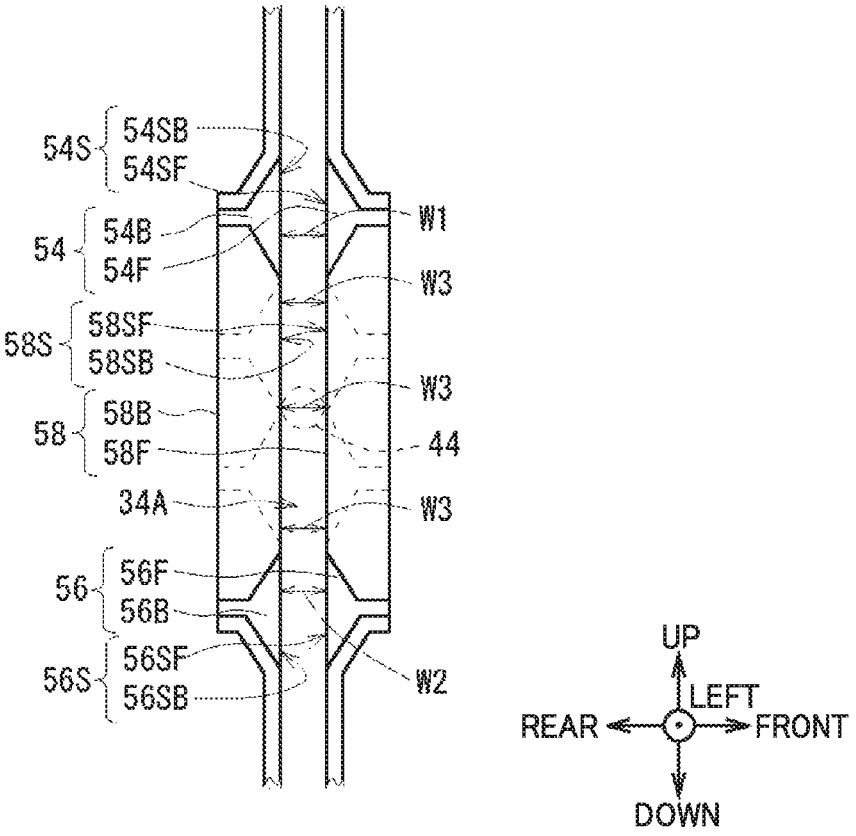
FIG. 9 is a left-side view showing a structure (1) of a movable guide according to the first exemplary embodiment.

As is shown in FIG. 8 and FIG. 9, a distribution conveyor unit front-side fixed guide 54F and a distribution conveyor unit rear-side fixed guide 54B, which together form a pair, are fixed adjacent to each other at a predetermined separation distance in the slide direction at a conveyance path connecting portion where the distribution conveyor unit 26 connects to the delivery conveyor unit 34, and rollers and the like that sandwich and convey banknotes are also provided. Hereinafter, the distribution conveyor unit front-side fixed guide 54F and the distribution conveyor unit rear-side fixed guide 54B together serve as a pair of connection-side conveyor guides and may also be referred to collectively as a distribution conveyor unit fixed guide 54. A banknote conveyance path is formed in the distribution conveyor unit 26 between a distribution conveyor unit front-side guide surface 54SF, which is a surface on the rear side of the distribution conveyor unit front-side fixed guide 54F, and a distribution conveyor unit rear-side guide surface 54SB, which is a surface of the distribution conveyor unit rear-side fixed guide 54B that is parallel with and that faces the distribution conveyor unit front-side guide surface 54SF, and the gap between the distribution conveyor unit front-side guide surface 54SF and the distribution conveyor unit rear-side guide surface 54SB is taken as the conveyance path width which is a distance W1. As a consequence, the distribution conveyor unit rear-side fixed guide 54B guides the rear surface side of the banknotes, while the distribution conveyor unit front-side fixed guide 54F guides the front surface side of the banknotes. As is shown in FIG. 7B, downward-facing distal end portions of each of the distribution conveyor unit rear-side fixed guide 54B and the distribution conveyor unit front-side fixed guide 54F are formed in a comb tooth shape, and protrude downwards below a bottom end of the left-side plate 27L and the right-side plate 27R of the distribution conveyor unit housing 27. Hereinafter, the distribution conveyor unit front-side guide surface 54SF and the distribution conveyor unit rear-side guide surface 54SB together serve as connection subject conveyance path guide surfaces and may also be referred to collectively as a distribution conveyor unit guide surface 54S.

As is shown in FIG. 8 and FIG. 9, storage box front-side fixed guide 56F and a storage box rear-side fixed guide 56B, which together form a pair, are fixed adjacent to each other at a predetermined separation distance in the slide direction at a conveyance path connecting portion where the storage box loading case 16 connects to the delivery conveyor unit 34, and rollers and the like that sandwich and convey banknotes are also provided. Hereinafter, the storage box front-side fixed guide 56F and the storage box rear-side fixed guide 56B together serve as a pair of connection-side conveyor guides and may also be referred to collectively as a storage box fixed guide 56. A banknote conveyance path is formed in the storage box loading case 16 between a storage box front-side guide surface 56SF, which is a surface on the rear side of the storage box front-side fixed guide 56F, and a storage box rear-side guide surface 56SB, which is a surface of the storage box rear-side fixed guide 56B that is parallel with and that faces the storage box front-side guide surface 56SF, and the gap between the storage box front-side guide surface 56SF and the storage box rear-side guide surface 56SB is taken as the conveyance path width which is a distance W2 which is the same as the distance W1. As a consequence, the storage box rear-side fixed guide 56B guides the rear surface side of the banknotes, while the storage box front-side fixed guide 56F guides the front surface side of the banknotes. As is shown in FIG. 7B, upward-facing distal end portions of each of the storage box rear-side fixed guide 56B and the storage box front-side fixed guide 56F are formed in a comb tooth shape, and protrude upwards above a top end of the right-side plate 16R and the left-side plate 16L of the storage box loading case 16. Hereinafter, the storage box front-side guide surface 56SF and the storage box rear-side guide surface 56SB together serve as connection subject conveyance path guide surfaces and may also be referred to collectively as a storage box guide surface 56S.

As is shown in FIG. 8 and FIG. 9, a front-side movable guide 58F and a rear-side movable guide 58B, which are each formed having a trapezoidal shape when seen in a side view and which together form a pair, are fixed adjacent to each other at a predetermined separation distance in the slide direction respectively to the front-side plate 42F and the rear-side plate 42B at a conveyance path connecting portion where the delivery conveyor unit 34 connects to the distribution conveyor unit 26 and the storage box loading case 16. In addition, the front-side movable guide 58F that serves as one surface conveyor guide, and the rear-side movable guide 58B that serves as another surface conveyor guide are also fixed to the left-side plate 42L and the right-side plate 42R. Hereinafter, the front-side movable guide 58F and the rear-side movable guide 58B may also be referred to collectively as a pair of movable guides 58. A delivery conveyance path 34A is formed between a front-side guide surface 58SF, which is a surface on the rear side of the front-side movable guide 58F, and a rear-side guide surface 58SB, which is a surface of the rear-side movable guide 58B that is parallel with and that faces the front-side guide surface 58SF, and the width of this delivery conveyance path 34A is a distance between the front-side guide surface 58SF and the rear-side guide surface 58SB. As a consequence, the rear-side movable guide 58B guides the rear surface side of the banknotes, while the front-side movable guide 58F guides the front surface side of the banknotes. As is shown in FIG. 7B, upward-facing distal end portions of each of the rear-side movable guide 58B and the front-side movable guide 58F are formed in a comb tooth shape, and protrude above the strongbox top plate 15T. As a result, they mesh respectively with the distribution conveyor unit rear-side fixed guide 54B and the distribution conveyor unit front-side fixed guide 54F. In addition, the downward-facing distal end portions of each of the rear-side movable guide 58B and the front-side movable guide 58F are formed in a comb tooth shape, and protrude below the strongbox top plate 15T (namely, inside the strongbox housing 15). As a result, they mesh respectively with the storage box rear-side fixed guide 56B and the storage box front-side fixed guide 56F.

As is shown in FIG. 9, the width of the conveyance path in the movable guide 58 is set to the same distance W3 in an upper end portion thereof where the movable guide 58 meshes with the distribution conveyor unit fixed guide 54, in a central portion thereof, and in a lower end portion thereof where the movable guide 58 meshes with the storage box fixed guide 56. This distance W3, which is the width of the conveyance path in the movable guide 58, is the same as the distance W1, which is the width of the conveyance path in the distribution conveyor unit fixed guide 54, and the distance W2, which is the width of the conveyance path in the storage box fixed guide 56. Namely, the conveyance path width of the delivery conveyance path 34A is formed the same as the conveyance path width of the distribution conveyance path 26A and the storage box conveyance path 20AX from one end to the other end thereof in the conveyance direction (i.e., the up-down direction).

Here, an axis of rotation of the above-described delivery conveyor unit housing shaft 44 is located between the front-side movable guide 58F and the rear-side movable guide 58B, and substantially in a central portion in the up-down direction in which the banknotes are conveyed from the delivery conveyor unit fixed guide 54 towards the storage box fixed guide 56.

Because the front-side movable guide 58F and the rear-side movable guide 58B are integrated into a single body via the delivery conveyor unit housing 42, when the front-side plate 42F and the rear-side plate 42B are rotating around the delivery conveyor unit housing shaft 44, they rotate around the delivery conveyor unit housing shaft 44 while maintaining their positional relationship to each other, namely, while maintaining a parallel relationship at the same conveyance path width with the distribution conveyance path 26A and the storage box conveyance path 20AX. It should be noted that a component (not shown in the drawings) that restricts the front-side movable guide 58F and the rear-side movable guide 58B from rotating beyond a predetermined angle is also provided in the delivery conveyor unit 34.

1.5. Operation and Effects

In the above-described structure, as is shown in FIG. 8, in the automatic teller machine 1, when the distribution conveyor unit 26, the linking portion 30, and the storage box loading case 16 are set in place without any discrepancies in their positioning relative to each other, the movable guides 58 are aligned in a vertical attitude, and the upper end portions of each one are engaged with the distribution conveyor unit fixed guide 54, while the lower end portions of each are engaged with the storage box fixed guide 56, and the delivery conveyance paths 33A through 38A are connected to the distribution conveyance path 26A, and to the storage box conveyance paths 19AX through 24AX respectively.

Figure 10:
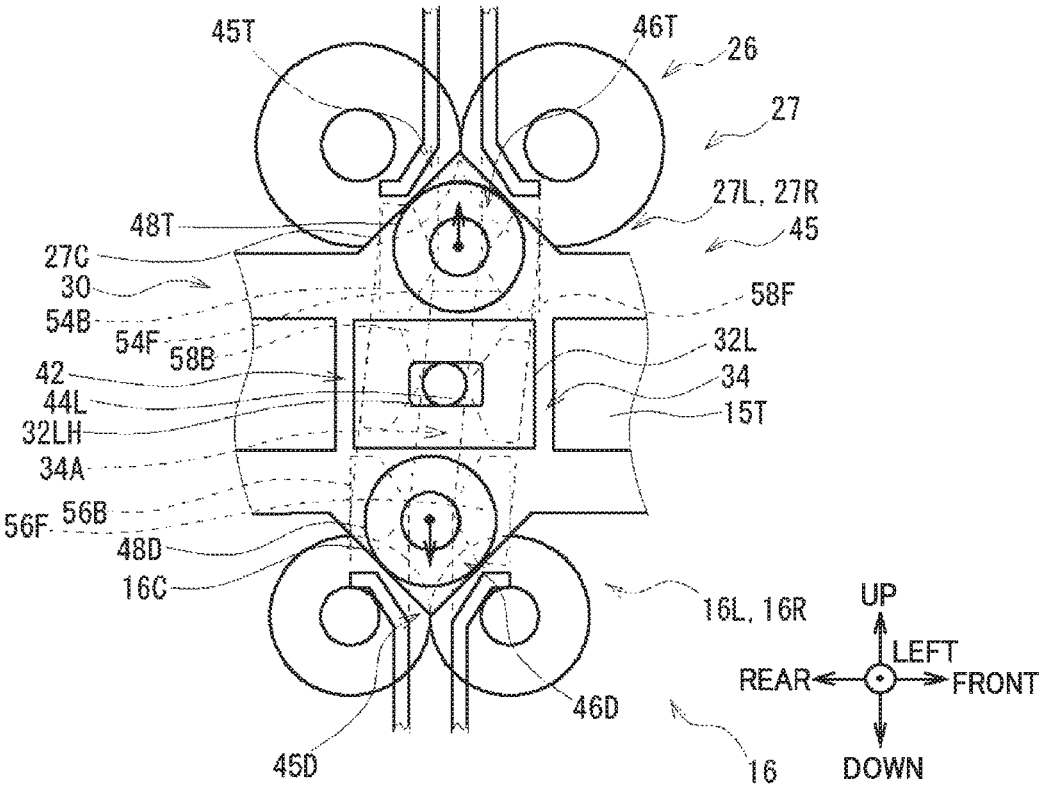
FIG. 10 is a left-side view showing the structure (2) of the positioning portion according to the first exemplary embodiment.
Figure 11:
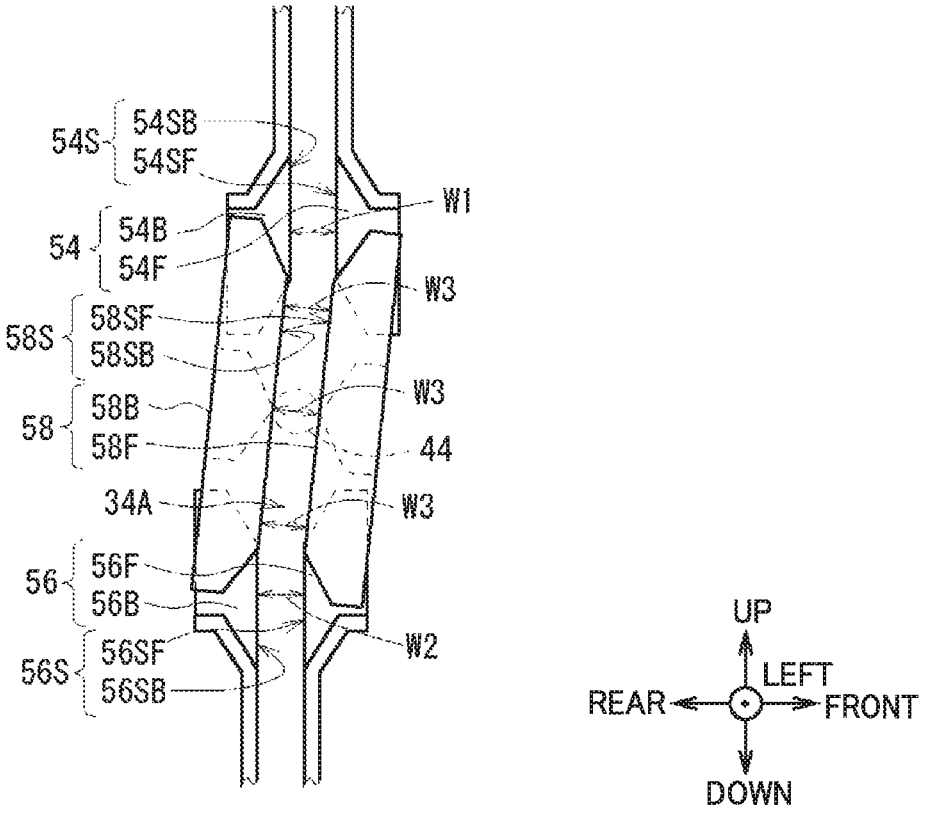
FIG. 11 is a left-side view showing the structure (2) of the movable guide according to the first exemplary embodiment.

In contrast, as is shown in FIG. 10 and FIG. 11, if, for example, the distribution conveyor unit 26 is offset from its correct position by, for example, approximately 3 mm towards the front, and the storage box loading case 16 is offset from its correct position by, for example, 3 mm towards the rear, the front-side plate 42F and the rear-side plate 42B are rotated clockwise, when seen in a left-side view, around the delivery conveyor unit housing shaft 44 by an angular distance that matches the positions of the distribution conveyor unit housing recesses 27C and the storage box loading case recesses 16C such that the upper-side positioning rollers 48T remain in place inside the distribution conveyor unit housing recesses 27C within a range whereby the upper-side positioning rollers 48T do not come out from the distribution conveyor unit housing recesses 27C, and such that the lower-side positioning rollers 48D remain in place inside the storage box loading case recesses 16C within a range whereby the lower-side positioning rollers 48D do not come out from the storage box loading case recesses 16C.

Because of this, in the automatic teller machine 1, when the position of the distribution conveyor unit 26 is offset towards the front side of a point directly above the linking portion 30, or when the position of the storage box loading case 16 is offset towards the rear side of a point directly below the linking portion 30, the movable guides 58 are aligned at an attitude in which the upper end portion thereof is tilted towards the front around the axis provided by the delivery conveyor unit housing shaft 44, while the front-side guide surfaces 58SF and the rear-side guide surfaces 58SB are held in parallel with each other extending from the top end to the bottom end of each, and while the conveyance path width is maintained, and the upper end portions of the movable guides 58 are then engaged with the distribution conveyor unit fixed guide 54, while the lower end portions thereof are engaged with the storage box fixed guide 56, and the delivery conveyance paths 33A through 38A are connected to the distribution conveyance path 26A, and to the storage box conveyance paths 19AX through 24AX respectively.

Figure 12:
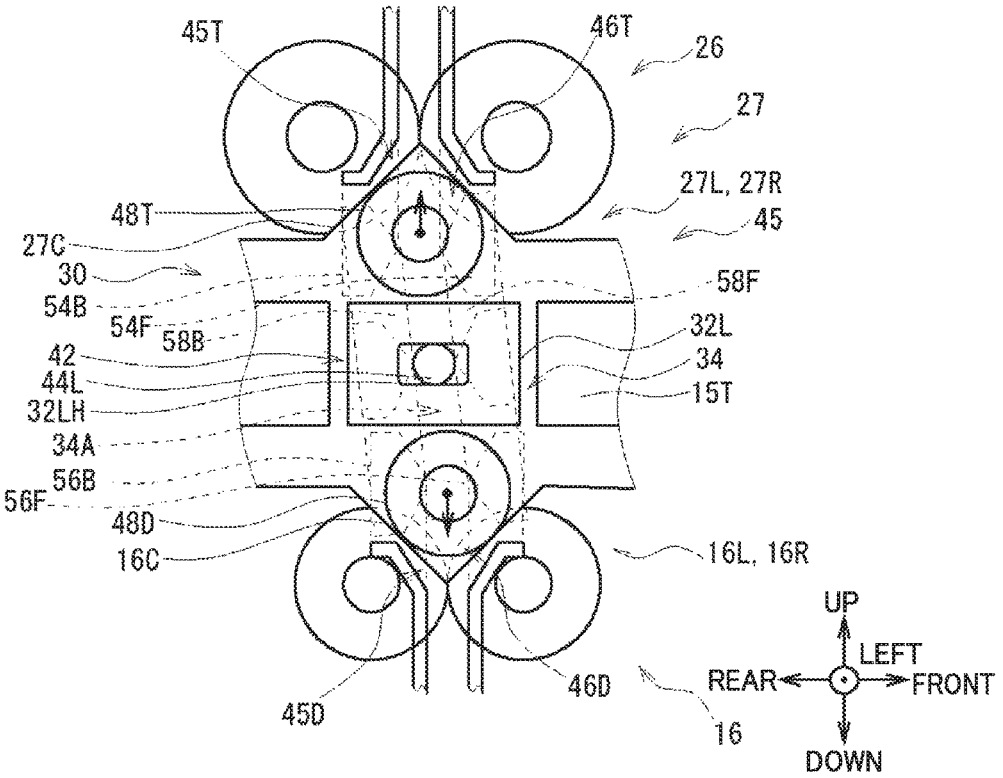
FIG. 12 is a left-side view showing the structure (3) of the positioning portion according to the first exemplary embodiment.
Figure 13:
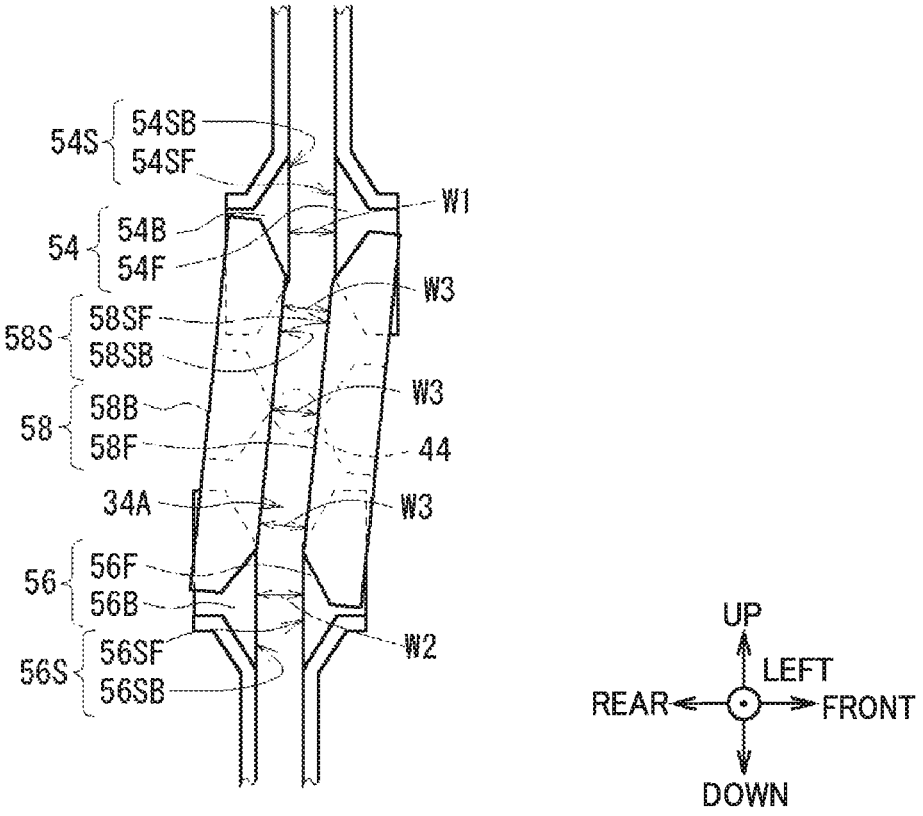
FIG. 13 is a left-side view showing the structure (3) of the movable guide according to the first exemplary embodiment.

On the other hand, as is shown in FIG. 12 and FIG. 13, if, for example, the distribution conveyor unit 26 is offset from its correct position by, for example, approximately 3 mm towards the rear, and the storage box loading case 16 is offset from its correct position by, for example, 3 mm towards the front, the front-side plate 42F and the rear-side plate 42B are rotated anticlockwise, when seen in a left-side view, around the delivery conveyor unit housing shaft 44 by an angular distance that matches the positions of the distribution conveyor unit housing recesses 27C and the storage box loading case recesses 16C such that the upper-side positioning rollers 48T remain in place inside the distribution conveyor unit housing recesses 27C within a range whereby the upper-side positioning rollers 48T do not come out from the distribution conveyor unit housing recesses 27C, and such that the lower-side positioning rollers 48D remain in place inside the storage box loading case recesses 16C within a range whereby the lower-side positioning rollers 48D do not come out from the storage box loading case recesses 16C.

Because of this, in the automatic teller machine 1, when the position of the distribution conveyor unit 26 is offset towards the rear side of a point directly above the linking portion 30, or when the position of the storage box loading case 16 is offset towards the front side of a point directly below the linking portion 30, the movable guides 58 are aligned at an attitude in which the upper end portion thereof is tilted towards the rear around the axis provided by the delivery conveyor unit housing shaft 44, while the front-side guide surfaces 58SF and the rear-side guide surfaces 58SB are held in parallel with each other extending from the top end to the bottom end of each, and while the conveyance path width is maintained, and the upper end portions of the movable guides 58 are then engaged with the distribution conveyor unit fixed guide 54, while the lower end portions thereof are engaged with the storage box fixed guide 56, and the delivery conveyance paths 33A through 38A are connected to the distribution conveyance path 26A, and to the storage box conveyance paths 19AX through 24AX respectively.

Figure 14:
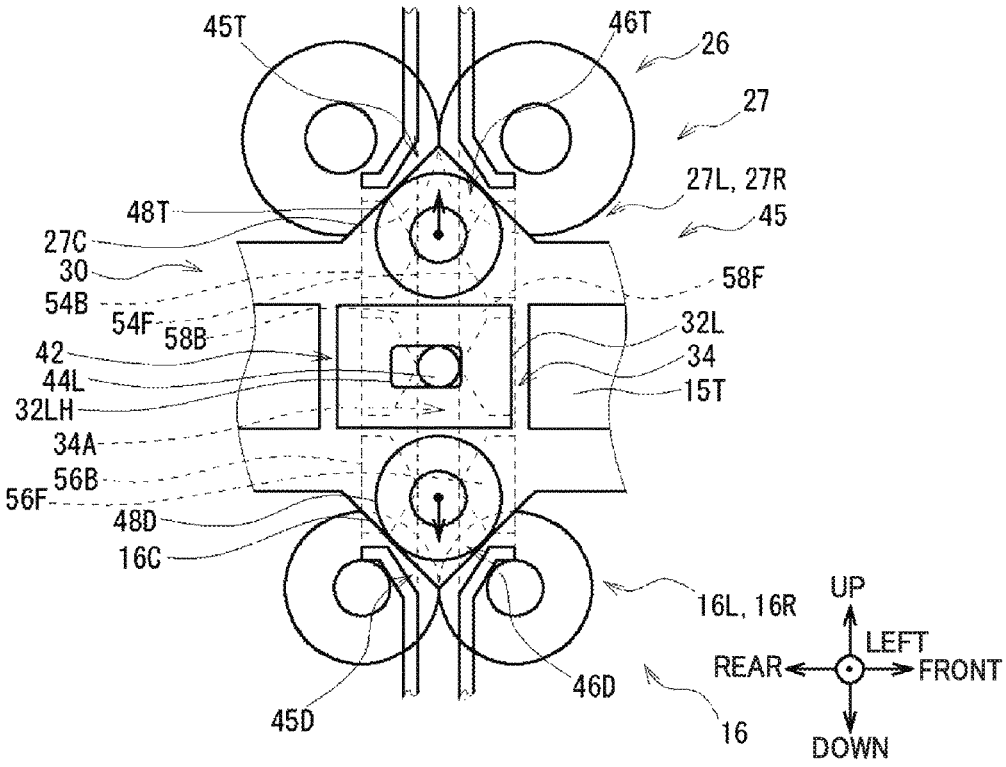
FIG. 14 is a left-side view showing the structure (4) of the positioning portion according to the first exemplary embodiment.

Moreover, as is shown in FIG. 14, if, for example, the distribution conveyor unit 26 and the storage box loading case 16 are both offset from their correct positions towards the front, the front-side plate 42F and the rear-side plate 42B are moved towards the front by causing the delivery conveyor unit housing left-side shaft 44L to slide towards the front inside the left-side bracket hole portion 32LH, and by causing the delivery conveyor unit housing right-side shaft 44R (not shown in the drawings) to slide towards the front inside the right-side bracket hole portion 32RH (not shown in the drawings) such that the upper-side positioning rollers 48T remain in place inside the distribution conveyor unit housing recesses 27C within a range whereby the upper-side positioning rollers 48T do not come out from the distribution conveyor unit housing recesses 27C, and such that the lower-side positioning rollers 48D remain in place inside the storage box loading case recesses 16C within a range whereby the lower-side positioning rollers 48D do not come out from the storage box loading case recesses 16C.

Because of this, in the automatic teller machine 1, if the position of the distribution conveyor unit 26 is offset towards the front side of a point directly above the linking portion 30, and the position of the storage box loading case 16 is also offset towards the front side of a point directly below the linking portion 30, the movable guides 58 are both moved in parallel with each other towards the front side, while the front-side guide surfaces 58SF and the rear-side guide surfaces 58SB are held in parallel with each other extending from the top end to the bottom end of each, and while the conveyance path width is maintained, and the upper end portions of the movable guides 58 are then engaged with the distribution conveyor unit fixed guide 54, while the lower end portions thereof are engaged with the storage box fixed guide 56, and the delivery conveyance paths 33A through 38A are connected to the distribution conveyance path 26A, and to the storage box conveyance paths 19AX through 24AX respectively. The case described above is one in which the positions of both the delivery conveyance path 26 and the storage box loading case 16 are offset towards the front side, however, in a case in which the positions of both the delivery conveyance path 26 and the storage box loading case 16 are offset towards the rear side, the movable guides 58 are moved towards the rear by causing the delivery conveyor unit housing left-side shaft 44L to slide towards the rear inside the left-side bracket hole portion 32LH, and by causing the delivery conveyor unit housing right-side shaft 44R (not shown in the drawings) to slide towards the rear inside the right-side bracket hole portion 32RH (not shown in the drawings).

In this manner, in the automatic teller machine 1, in the upper unit storage state and the storage box loading case storage state, irrespective of the positions of the delivery conveyor unit 26 and the storage box loading case 16 relative to the linking portion 30, the delivery conveyance paths 33A through 38A are able to be connected to the distribution conveyance path 26A, and to the storage box conveyance paths 19AX through 24AX respectively without there being any change in the conveyance path widths of the front-side movable guide 58F and the rear-side movable guide 58B, and without there being any change in the parallel relationship between the front-side guide surfaces 58SF and the rear-side movable guides 58B.

Accordingly, in the automatic teller machine 1, even if the movable guides 58 of the delivery conveyor units 33 through 38 are engaged with the corresponding distribution conveyor unit fixed guides 54 of the delivery conveyor unit 26 while the movable guides 58 are in a tilted attitude towards the front side or the rear side, it is possible to reliably prevent the distal end portion of the movable guides 58 and the lower end portions of the distribution conveyor unit fixed guides 54 from entering into the connecting portions where the upper end portions of the delivery conveyance paths 33A through 38A are connected by these engagements to the lower end portions of the distribution conveyance path 26A, and thereby causing step portions or recessed portions to be formed. In addition, in the automatic teller machine 1, even if the movable guides 58 of the delivery conveyor units 33 through 38 are engaged with the corresponding storage box fixed guides 56 of the storage box conveyor units 19A through 24A while the movable guides 58 are in a tilted attitude towards the front side or the rear side, it is possible to reliably prevent the distal end portion of the movable guides 58 and the upper end portions of the storage box fixed guides 56 from entering into the connecting portions where the lower end portions of the delivery conveyance paths 33A through 38A are connected by these engagements to the upper end portions of the storage box conveyance paths 19AX through 24AX, and thereby causing step portions or recessed portions to be formed.

In addition, in the automatic teller machine 1, by connecting the upper end portions of the delivery conveyance paths 33A through 38A to the lower end portions of the distribution conveyance path 26A, and by connecting the lower end portions of the delivery conveyance paths 33A through 38A to the upper end portions of the storage box conveyance paths 19AX through 24AX such that no step portions or recessed portions are formed within the connecting portions, and by also maintaining the same conveyance path width as that of the distribution conveyance path 26A and the storage box conveyance path 20AX, and also keeping the front-side guide surfaces 58SF in parallel with the rear-side movable guides 58 for the entire distance from the connecting portions with the lower end portions of the distribution conveyance path 26A as far as the connecting portions with the upper end portions of the storage box conveyance paths 19AX through 24AX, it is possible when banknotes are actually being conveyed in sequence along the distribution conveyance path 26A and the delivery conveyance paths 33A through 38A to essentially reliably prevent the banknotes from becoming jammed or torn in these connecting portions.

Moreover, in the automatic teller machine 1, the movable guides 58 in each one of the plurality of delivery conveyor units 33 through 38 all rotate independently of each other. As a consequence, in the automatic teller machine 1, even if differences occur between the amounts and the directions of the respective positioning discrepancies between the plurality of lower end portions of the distribution conveyance path 26A and the respective corresponding delivery conveyance paths 33A through 38A, it is still possible to individually position the upper end portions of the respective corresponding delivery conveyance paths 33A through 38A accurately relative to the plurality of lower end portions of the distribution conveyance path 26A, and then connect them together.

Moreover, in the automatic teller machine 1, it is also possible to accurately position the individual end portions of the respective delivery conveyance paths 33A through 38A relative to the corresponding plurality of lower end portions of the delivery conveyance path 26A and the corresponding plurality of upper end portions of the storage box conveyance paths 19AX through 24AX, and then connect them together. As a consequence, in the automatic teller machine 1, when the automatic teller machine 1 is being assembled in a factory, or when the upper unit 13 is being replaced on-site, the accuracy required when adjusting the position of the upper unit 13 in the front-rear direction can be reduced to a level where the positioning can be achieved simply by rotating the movable guides 58. Moreover, in the automatic teller machine 1, when the reject box 19 or the banknote storage boxes 20 through 24 are being replaced from the storage box loading case 16 and this storage box loading case 16 is being stored, the accuracy required when adjusting the position of the storage box loading case 16 in the front-rear direction can be reduced to a level where the positioning can be achieved simply by rotating the movable guides 58.

Moreover, in the automatic teller machine 1, when the automatic teller machine 1 is being assembled in a factory, or when the upper unit 13 is being replaced on-site, if the accuracy required when adjusting the position of the upper unit 13 in the front-rear direction can be reduced, then the task of adjusting the position of the upper unit 13 in the front-rear direction can be simplified by a corresponding amount. Moreover, in the automatic teller machine 1, when the reject box 19 or the banknote storage boxes 20 through 24 are being replaced from the storage box loading case 16 and this storage box loading case 16 is being stored, if the accuracy required when adjusting the position of the storage box loading case 16 in the front-rear direction can be reduced, then the task of adjusting the position of the storage box loading case 16 in the front-rear direction can be simplified by a corresponding amount.

Here, as in an automatic teller machine described in Japanese Patent Application Laid-Open (JP-A) No. 2013-242608, there is provided an automatic teller machine in which a front-side movable guide and a rear-side movable guide are rotatably provided with surfaces of base portions thereof being made to face each other, and the front-side movable guide and the rear-side movable guide are linked together via a linking plate such that they are able to rotate with surfaces of each one remaining mutually in parallel. In the case of a structure such as this, if both the front-side movable guide and the rear-side movable guide are tilted, then although the parallel relationship between the two is maintained, the conveyance path width becomes narrower than the conveyance path width of the distribution conveyance path and the storage box conveyance path.

In contrast to this, in the automatic teller machine 1, the front-side movable guide 58F and the rear-side movable guide 58B are formed as an integral body via the delivery conveyor unit housing 42, and are able to rotate around the delivery conveyor unit housing shaft 44 which, when seen in a side view, is located between the front-side movable guide 58F and the rear-side movable guide 58B, and substantially in a central portion in the up-down direction. As a consequence, in the automatic teller machine 1, the movable guides 58 can be tilted while the parallel relationship between the front-side movable guide surface 58F and the rear side movable guide surface 58SB is maintained, and the conveyance path width is the same as in the distribution conveyance path 26A and the storage box conveyance paths 19AX through 24AX.

Moreover, as in the automatic teller machine described in Japanese Patent Application Laid-Open (JP-A) No. 2013-242608, there is provided an automatic teller machine in which rotation control levers that are linked to movable guides such that bearings are offset at predetermined intervals in a left-right direction in each delivery conveyor unit, and that, in an upper unit pull-out state, pivot in a pull-out direction, are attached to a delivery conveyor unit housing, and pressing arms are provided on the delivery conveyor unit housing such that pressing portions are offset in the left-right direction at the same intervals as the bearing intervals, and when an upper unit having the distribution conveyor unit is being stored, then simply as a result of a maintenance operator pressing this upper unit inside an apparatus cabinet, the movement of the distribution conveyor unit generated by this pressing causes the pressing portions of the plurality of pressing arms of the distribution conveyor unit to press respectively against the bearing of the corresponding rotation control lever, so that the movable guides are all rotated collectively to an angle that matches the positions of the distribution conveyor unit fixed guides.

However, in this case, because a larger space in the left-right direction becomes necessary as the number of delivery conveyor units increases, this causes the size of the automatic teller machine to also increase. Moreover, when the delivery conveyor units are replaced during maintenance, if the maintenance operator fails to fix in place the delivery conveyor unit that is provided with the rotation control lever for the particular mounting hole portion out of the plurality of mounting hole portions in which the delivery conveyor unit that is to undergo maintenance is fixed, then there is a possibility that this delivery conveyor unit will break.

In contrast to this, in the automatic teller machine 1 of the present exemplary embodiment, the distribution conveyor unit housing recesses 27C and the upper-side positioning rollers 48T are provided at positions in the slide direction for all of the delivery conveyor units 33 through 38 such that the positions thereof in the left-right direction in each of the delivery conveyor units 33 through 38 do not shift. Because of this, in the automatic teller machine 1, a large space in the left-right direction is not required, and any increase in the size of the apparatus can be prevented. Moreover, in the automatic teller machine 1, when the delivery conveyor units 33 through 38 are replaced during maintenance, because the upper-side positioning portions 45T of all of the delivery conveyor units 33 through 38 are constructed in the same way, any possibility of the delivery conveyor units 33 through 38 being damaged can be eliminated.

According to the above-described structure, in the automatic teller machine 1 there are provided: a distribution conveyor unit fixed guide 54 and a storage box fixed guide 56, which are a pair of connection-side conveyor guides, between which a conveyance path for sheet paper in the form of banknotes is formed by a distribution conveyor unit front-side guide surface 54SF and a distribution conveyor unit rear-side guide surface 54SB, and by a storage box front-side guide surface 56SF and a storage box conveyor unit rear-side guide surface 56SB, which are pairs of connection subject conveyance path guide surfaces that face each other with a predetermined conveyance path width between them and are parallel to each other; movable guides 58, which are pairs of conveyor guides, in which a banknote conveyance path is formed between a front-side guide surface 58SF and a rear side guide surface 58SB, which are guide surfaces that face each other with the same conveyance path width between them as the conveyance path widths between the distribution conveyor unit fixed guide 54 and the storage box fixed guide 56 and that are parallel to each other, with an end portion in the banknote conveyance direction of the movable guides 58 being engaged with end portions of the distribution conveyor unit fixed guide 54 and the storage box fixed guide 56; and a movable guide supporting portion 60 which is a supporting portion that rotatably supports the movable guides 58 in accordance with the positions of the distribution conveyor unit fixed guide 54 and the storage box fixed guide 56 such that the conveyance path widths are maintained and such that the state in which the front-side guide surface 58SF and the rear-side guide surface 585B remain parallel to each other is maintained.

As a consequence, in the automatic teller machine 1, even if the front-side movable guides 58F and the rear-side movable guides 58B are engaged with the distribution conveyor unit fixed guide 54 and the storage box fixed guide 56 while the front-side movable guides 58F and the rear-side movable guides 58B are in a tilted attitude towards the front side or the rear side because of positioning discrepancies when the distribution conveyance path 26A or the storage box conveyance paths 19AX through 24AX were positioned relative to the delivery conveyance paths 33 through 38A, because the distribution conveyance path 26A, the delivery conveyance paths 33A through 38A, and the storage box conveyance paths 19AX through 24AX are connected together without there being any change in the conveyance path widths, it is possible to reliably prevent the conveyance path width of the delivery conveyance paths 33A through 38A from becoming narrower than the conveyance path widths of the distribution conveyance path 26A and the storage box conveyance paths 19AX through 24AX, and to reliably prevent step portions or recessed portions from being formed inside the connecting portions.

2. Second Exemplary Embodiment

2-1. Structure of an Automatic Teller Machine

As is shown in FIG. 1 and FIG. 2, compared with the automatic teller machine 1 of the first exemplary embodiment, in an automatic teller machine 101 of the second exemplary embodiment, a distribution conveyor unit 126, delivery conveyor units 133 through 138 of a linking portion 130, and a storage box loading case 116 differ from the distribution conveyor unit 26, the delivery conveyor units 33 through 38 of the linking portion 30, and the storage box loading case 16, however, the remaining structure is the same as in the first exemplary embodiment.

2-2. Structure of a Linking Portion

Figure 15:
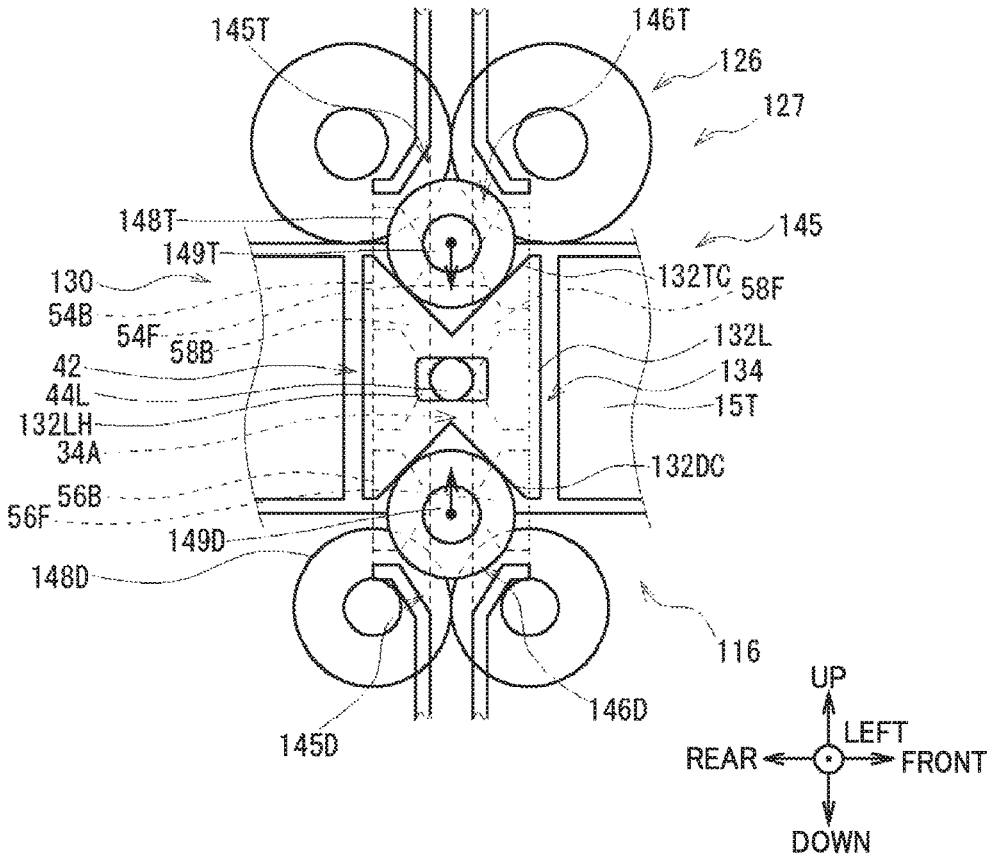
FIG. 15 is a left-side view showing a structure of a positioning portion according to a second exemplary embodiment.

In the linking portion 30, the delivery conveyor units 133 through 138 are mounted on a linking housing 131 (not shown in the drawings) in that sequence moving towards the rear. Because the delivery conveyor units 133 through 138 basically have the same structure, hereinafter, only the structure of the delivery conveyor unit 134 will be described. As is shown in FIG. 15, an upper-side positioning portion 145T is formed by an upper-side urging portion 146T of the distribution conveyor unit 126, and a bracket upper-side recess 132TC of a left-side bracket 132L of the delivery conveyor unit 134, while the lower-side positioning portion 145D is formed by a lower-side urging portion 146D of the storage box loading case 16, and a bracket lower-side recess 132DC of the left-side bracket 132L of the delivery conveyor unit 134.

The upper-side urging portion 146T is formed by an upper-side supporting portion (not shown in the drawings), an upper-side positioning roller 148T, an upper-side positioning roller shaft 149T, and upper-side springs (not shown in the drawings). The upper-side positioning roller 148T is constructed such that the upper-side positioning roller shaft 149T is supported such that it is able to slide inside upper-side supporting portion holes (not shown in the drawings) that have been formed in a distribution conveyor unit housing 127, so that the upper-side positioning roller 148T is able to be moved in directions in which it approaches or moves away from the delivery conveyor unit housing 42 while being urged downwards towards the delivery conveyor unit housing 42 by upper-side springs (not shown in the drawings), and is also able to rotate freely when seen in a side view around the upper-side positioning roller shaft 149T. Because the lower-side urging portion 146D is formed so as to be in point symmetry with the upper-side urging portion 146T centering around the delivery conveyor unit housing shaft 44, a description thereof will be omitted. The lower-side positioning roller 148D is able to be moved in directions in which it approaches or moves away from the delivery conveyor unit housing 42 while being urged upwards towards the delivery conveyor unit housing 42, and is also able to rotate freely when seen in a side view around the lower-side positioning roller shaft 149D.

In the delivery conveyor units 133 through 138, by pressing the upper-side positioning roller 148T against an upper end surface of the bracket upper-side recess 132TC, the distribution conveyor unit 126 is positioned relative to the delivery conveyor units 133 through 138. Moreover, in the delivery conveyor units 133 through 138, by pressing the lower-side positioning roller 148D against a lower end surface of the bracket lower-side recess 132DC, the storage box loading case 116 is positioned relative to the delivery conveyor units 133 through 138.

In the delivery conveyor units 133 through 138, when the upper-side positioning roller 148T has been fitted into the bracket upper-side recess 132TC, if a predetermined force or greater is applied in the slide direction to the upper unit 13, then by compressing the upper-side springs (not shown in the drawings) and causing the upper-side positioning roller 148T to move in a direction in which it separates from the delivery conveyor unit housing 42, the upper-side positioning roller 148T is removed from the bracket upper-side recess 132TC, and is pressed against the upper end surface of the strongbox top plate 15T. Furthermore, in the delivery conveyor units 133 through 138, when the lower-side positioning roller 148D has been fitted into the bracket lower-side recess 132DC, if a predetermined force or greater is applied in the slide direction to the storage box loading case 116, then by compressing the lower-side springs (not shown in the drawings) and causing the lower-side positioning roller 148D to move in a direction in which it separates from the delivery conveyor unit housing 42, the lower-side positioning roller 148D is removed from the bracket lower-side recess 132DC, and is pressed against the lower end surface of the strongbox top plate 15T.

In this way, in the linking portion 130, by engaging the upper-side positioning rollers 148T in the corresponding bracket upper-side recess 132TC of each one of the delivery conveyor units 133 through 138, in the upper unit storage state, the distribution conveyor unit 126 is positioned relative to the linking portion 130. Moreover, in the linking portion 130, by engaging the lower-side positioning rollers 148D in the corresponding bracket lower-side recess 132DC of each one of the delivery conveyor units 133 through 138, in the storage box loading case storage state, the storage box loading case 116 is positioned relative to the linking portion 130.

Generally speaking, the surface of the strongbox housing 15 is often more uneven than the surfaces of the distribution conveyor unit housing 127 and the storage box loading case 116. In the automatic teller machine 101, when the distribution conveyor unit 126 and the storage box loading case 116 are being inserted or removed, because the upper-side positioning rollers 148T and the lower-side positioning rollers 148D are in contact with the surface of the strongbox housing 15 as they roll over it, there is a possibility that the upper-side positioning rollers 148T and the lower-side positioning rollers 148D will wear more quickly than the upper-side positioning rollers 48T and the lower-side positioning rollers 48D which are in contact with the surfaces of the distribution conveyor unit housing 27 and the storage box loading case 16 as they roll over them, as is the case in the automatic teller machine 1.

Moreover, compared with when the upper-side positioning rollers 48T that are provided in the delivery conveyor unit housing 42 are placed against the distribution conveyor unit housing 27, and the lower-side positioning rollers 48D that are provided in the delivery conveyor unit housing 42 are placed against the storage box loading case 16, as is the case in the automatic teller machine 1, in the automatic teller machine 101, because the upper-side positioning rollers 148T that are provided in the distribution conveyor unit housing 27 are placed against the bracket upper-side recesses 132TC, and the lower-side positioning rollers 148D that are provided in the storage box loading case 116 are placed against the bracket lower-side recesses 132DC, the distance from the contact point between the upper-side positioning rollers 148T and the bracket upper-side recesses 132TC to the delivery conveyor unit housing shaft 44, and the distance from the contact point between the lower-side positioning rollers 148D and the bracket lower-side recesses 132DC to the delivery conveyor unit housing shaft 44 are shorter than the distance from the contact point between the upper-side positioning rollers 48T and the distribution conveyor unit housing recesses 27C to the delivery conveyor unit housing shaft 44, and the distance from the contact point between the lower-side positioning rollers 48D and the storage box loading case 16C to the delivery conveyor unit housing shaft 44 in the automatic teller machine 1. Namely, in the automatic teller machine 101, the rotation angle of the movable guides 58 is set at a position that is closer to the center of rotation of the delivery conveyor unit housing 42 (i.e., the delivery conveyor unit housing shaft 44) that in the automatic teller machine 1. As a result of this, because it is possible to set the rotation angle of the movable guides 58 at a position that is further from the center of rotation delivery conveyor unit housing 42 in the automatic teller machine 1 than in the automatic teller machine 101, it is possible to minimize errors in the rotation angle of the movable guides 58, and the movable guides 58 can be rotated accurately to the positions of the distribution conveyor unit fixed guides 54 and the storage box fixed guides 56.

3. Additional Exemplary Embodiments

3-1. Additional Exemplary Embodiment 1

Figure 16:
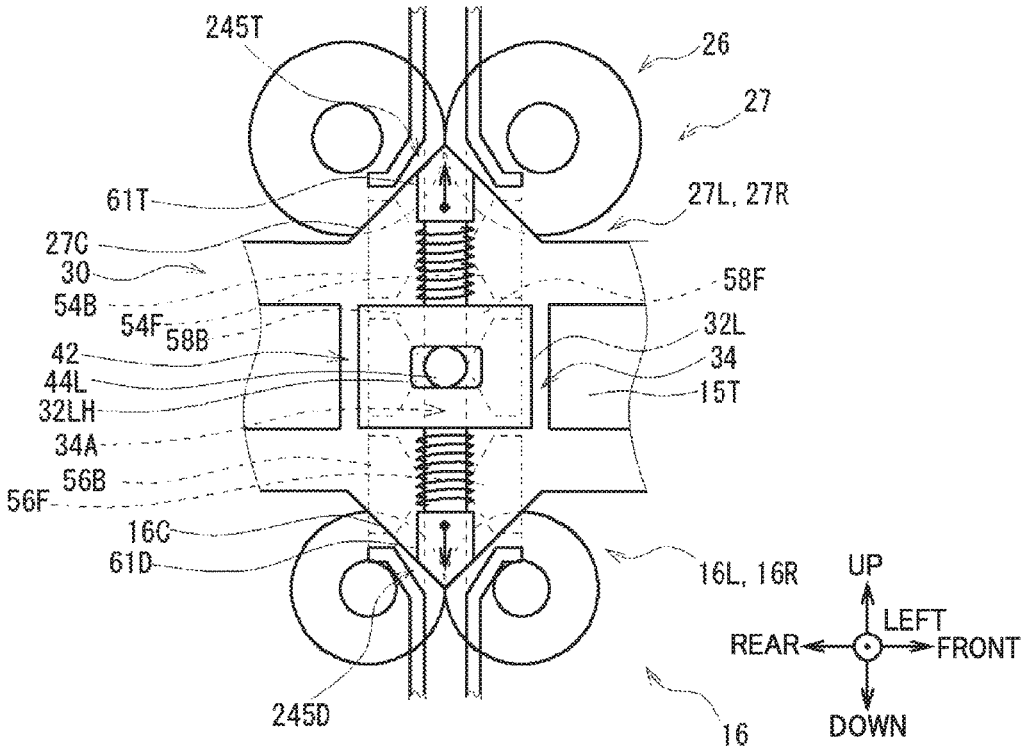
FIG. 16 is a left-side view showing a structure (1) of a positioning portion according to another exemplary embodiment.

In the above-described first exemplary embodiment a case is described in which the upper-side positioning rollers 48T are engaged with the distribution conveyor unit housing recesses 27C in the upper-side positioning portion 45T. However, the present invention is not limited to this. As in the case of an upper-side positioning portion 245T shown in FIG. 16, it is also possible to provide an upper-side positioning projection 61T whose upper end portion is shaped like a home plate (as in baseball), when seen in a side view, that engages with the distribution conveyor unit housing recesses 27C, and is urged upwards towards the distribution conveyor unit housing recesses 27C by a compression spring, and that is able to move in a direction in which it moves away from the distribution conveyor unit housing recesses 27C. It is also possible to provide a lower-side positioning projection 61D in the lower-side positioning portion 245T as well that is formed so as to be in point symmetry with the upper-side positioning portion 245T centering around the delivery conveyor unit housing shaft 44.

3-2. Additional Exemplary Embodiment 2

Figure 17:
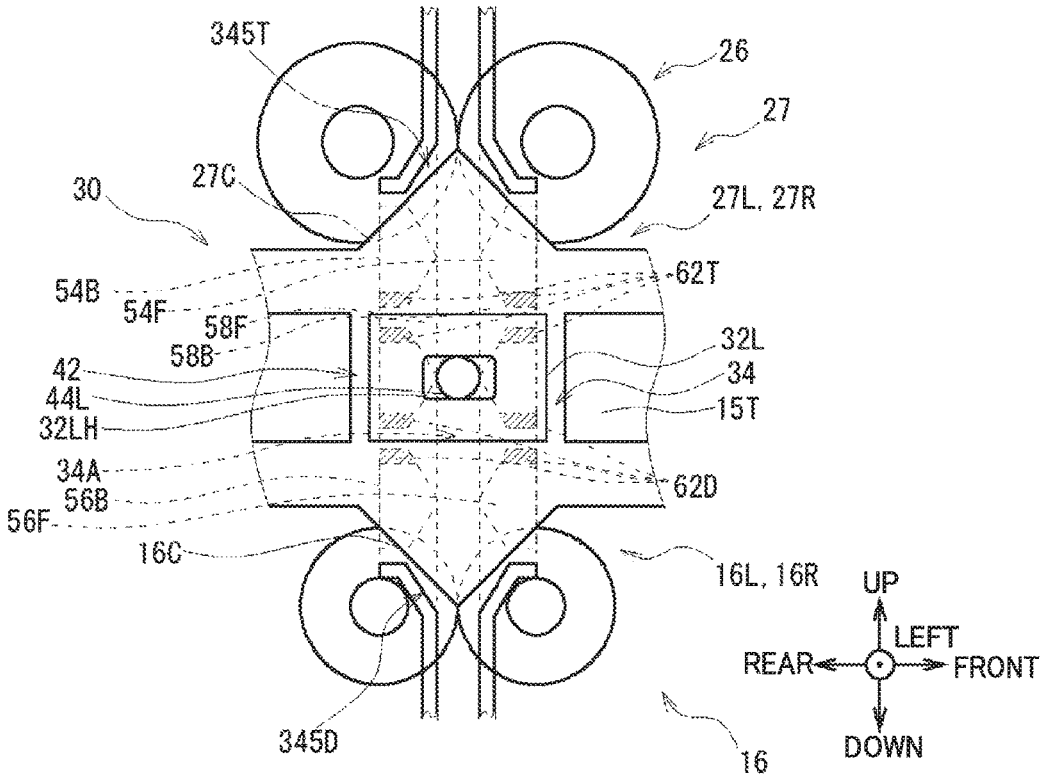
FIG. 17 is a left-side view showing a structure (2) of a positioning portion according to another exemplary embodiment.

Moreover, as in the case of an upper-side positioning portion 345T shown in FIG. 17, it is also possible to provide upper-side magnets 62T that mutually attract the comb tooth shaped distal end portions of the lower end portions of the distribution conveyor unit rear-side fixed guide 54B and the distribution conveyor unit front-side fixed guide 54F, and portions of the tooth comb-shaped portions of the rear-side movable guides 58B and the front-side movable guides 58F that face the distal end portions of the distribution conveyor unit rear-side fixed guide 54B and the distribution conveyor unit front-side fixed guide 54F, and to also provide lower-side magnets 62D that mutually attract the comb tooth shaped distal end portions of the upper end portions of the storage box rear-side fixed guide 56B and the storage box front-side fixed guide 56F, and portions of the tooth comb-shaped portions of the rear-side movable guides 58B and the front-side movable guides 58F that face the distal end portions of the storage box rear-side fixed guide 56B and the storage box front-side fixed guide 56F.

3-3. Additional Exemplary Embodiment 3

Figure 18:
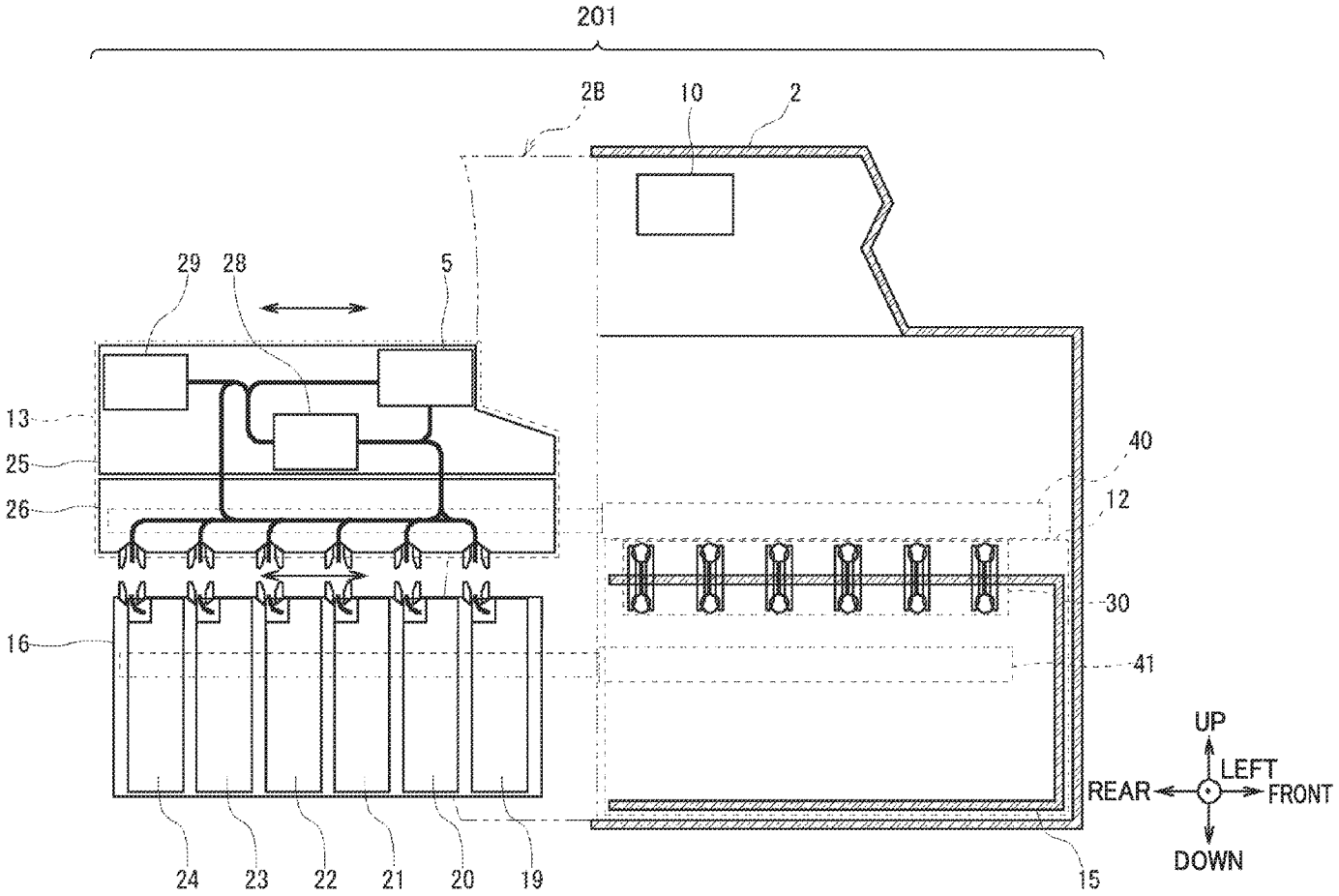
FIG. 18 is a left-side view showing a structure of an automatic teller machine when an upper unit and a storage box loading case according to another exemplary embodiment have been pulled out.

Moreover, in the above-described exemplary embodiment a case is described in which the apparatus cabinet front door 2A that covers the front surface of the apparatus cabinet 2, and the strongbox housing front door 15B that covers the front surface of the strongbox 15 are both provided such that they are able to be opened and closed, and when the apparatus cabinet front door 2A is opened, the upper unit 13 is able to be pulled out in a forward direction, which is the pull-out direction, and when the apparatus cabinet front door 2A and the strongbox housing front door 15B are opened, the storage box loading case 16 is able to be pulled out in the forward direction. However, the present invention is not limited to this and, as in the case of an automatic teller machine 201 shown in FIG. 18, it is also possible, for example, to provide an opening/closing apparatus cabinet rear door 2B that covers a rear surface of the apparatus cabinet 2, and an opening/closing strongbox housing rear door (not shown in the drawings) that covers a rear surface of the strongbox 15, and to open up the apparatus cabinet rear door 2B so as to pull out the upper unit 13 in a rearward direction, which is the pull-out direction, and to open up the apparatus cabinet rear door 2B and the strongbox housing rear door so as to pull out the storage box loading case 16 in the rearward direction. Alternatively, it is also possible for the present invention to be applied to an automatic teller machine in which both the apparatus cabinet front door 2A and the apparatus cabinet rear door 2B, and both the strongbox housing front door 15B and the strongbox housing rear door are provided.

Normally, in accordance with the situation in which an automatic teller machine is installed, an apparatus cabinet that is provided with either an apparatus cabinet front door or an apparatus cabinet rear door is selected, and a strongbox housing that is provided with either a strongbox housing front door or a strongbox housing rear door is selected.

Here, as is described above, as in the case of the automatic teller machine disclosed in Japanese Patent Application Laid-Open (JP-A) No. 2013-242608, there is provided an automatic teller machine in which rotation control levers that are linked to movable guides such that bearings are offset at predetermined intervals in a left-right direction in each delivery conveyor unit, and that, in an upper unit pull-out state, pivot in a pull-out direction, are attached to a delivery conveyor unit housing, and pressing arms are provided on the delivery conveyor unit housing such that pressing portions are offset in the left-right direction at the same intervals as the bearing intervals, and when an upper unit having the distribution conveyor unit is being stored, then simply as a result of a maintenance operator pressing this upper unit inside an apparatus cabinet, the movement of the distribution conveyor unit generated by this pressing causes the pressing portions of the plurality of pressing arms of the distribution conveyor unit to press respectively against the bearing of the corresponding rotation control lever, so that the movable guides are all rotated collectively to an angle that matches the positions of the distribution conveyor unit fixed guides.

Because of this, in this type of automatic teller machine, because the rotation control levers that are rotated in the pull-out direction in the upper unit pull-out state are rotated when the upper unit is being stored, in an automatic teller machine in which an apparatus cabinet front door is provided (also referred to below as a front-opening automatic teller machine), it is necessary to provide a delivery conveyor unit in which dedicated rotation control levers for a front-opening automatic teller machine are provided, while in an automatic teller machine in which an apparatus cabinet rear door is provided (also referred to below as a rear-opening automatic teller machine), it is necessary to provide a delivery conveyor unit in which dedicated rotation control levers for a rear-opening automatic teller machine are provided. Namely, it is necessary to prepare a delivery conveyor unit that is designed specifically for the particular upper unit pull-out direction.

In contrast to this, in the automatic teller machine 1 of the first exemplary embodiment, a structure for the mechanism of the positioning portion 45 is provided that has front-rear symmetry, and positioning is performed by fitting the upper-side positioning rollers 48T inside the distribution conveyor unit housing recesses 27C. Because of this, in the automatic teller machine 1, only one type of delivery conveyor unit needs to be provided for both a front-opening automatic teller machine and a rear-opening automatic teller machine, and there is no need to provide a delivery conveyor unit that is designed specifically for a particular upper unit pull-out direction.

3-4. Additional Exemplary Embodiment 4

Furthermore, in the above-described first exemplary embodiment a case is described in which both the upper-side positioning portion 45T and the lower-side positioning portion 45D are provided as the positioning portion 45. However, the present invention is not limited to this, and it is also possible for only one of the upper-side positioning portion 45T and the lower-side positioning portion 45D to be provided. This also applies in the second exemplary embodiment.

3-5. Additional Exemplary Embodiment 5

Furthermore, in the above-described first exemplary embodiment a case is described in which both the left-side positioning portion 45L and the right-side positioning portion 45R are provided as the positioning portion 45. However, the present invention is not limited to this, and it is also possible for only one of the left-side positioning portion 45L and the right-side positioning portion 45R to be provided. This also applies in the second exemplary embodiment.

3-6. Additional Exemplary Embodiment 6

Furthermore, in the above-described first exemplary embodiment a case is described in which the lower-side positioning rollers 48D are fitted into the storage box loading case recesses 16C in the storage box loading case 16. However, the present invention is not limited to this, and it is also possible for the lower-side positioning rollers 48D to be fitted into recesses provided in the reject box 19 and the banknote storage boxes 20 through 24.

3-7. Additional Exemplary Embodiment 7

Furthermore, in the above-described exemplary embodiments cases are described in which the front-side movable guides 58F and the rear-side movable guides 58B, which are formed integrally with each other, rotate around the delivery conveyor unit housing shafts 44. However, the present invention is not limited to this and, in short, it is sufficient if a structure is employed in which the front-side movable guides 58F and the rear-side movable guides 58B are able to rotate at the same time as the parallel relationship between the front-side guide surface 58SF and the rear-side guide surface 58SB, and the conveyance path width are both maintained.

3-8. Additional Exemplary Embodiment 8

Furthermore, in the above-described first exemplary embodiment a case is described in which distribution conveyor unit fixed guides 54 are provided respectively in each of the plurality of conveyance path connecting portions of the distribution conveyor unit 26, and movable guides that are able to rotate while maintaining the conveyance path width and while maintaining the parallel relationship between the front-side movable guides 58F and the rear-side movable guides 58B are provided in the plurality of delivery conveyor units 33 through 38. However, the present invention is not limited to this and it is also possible to provide distribution conveyor unit fixed guides that are each able to rotate while maintaining the conveyance path width and while maintaining the parallel relationship between distribution conveyor unit front-side fixed guides and distribution conveyor unit rear-side fixed guides, and to provide pairs of fixed conveyor guides instead of the front-side movable guides 58F and the rear-side movable guides 58B in the plurality of delivery conveyor units 33 through 38. The same applies for the movable guides 58 and the storage box fixed guides 56.

3-9. Additional Exemplary Embodiment 9

Furthermore, in the above-described exemplary embodiments cases are described in which, in the automatic teller machines 1 and 101 which handle cash, the present invention is applied to the conveyance of banknotes as the conveyed media. However, the present invention is not limited to this, and the present invention may also be applied to a variety of apparatuses that convey thin, paper-shaped media such as, for example, gift vouchers, cash vouchers, and admission tickets and the like. Moreover, the present invention may also be applied to cash processing apparatuses that are formed by combining a variety of different types of apparatus that perform various processing relating to the handling of banknotes and coins such as, for example, banknote depositing and dispensing machines that receive or dispense banknotes, or small bundle wrapping and dispensing machines that wrap a predetermined number of banknotes into bundles.

3-10. Additional Exemplary Embodiment 10

Furthermore, in the above-described exemplary embodiments cases are described in which the linking portion 30, which serves as a sheet paper conveyor apparatus, is formed by the movable guides 58, which serve as conveyor guides, and the movable guide support portions 60, which serve as supporting portions. However, the present invention is not limited to this, and it is also possible to form a sheet paper conveyor apparatus using conveyor guides having a variety of other structures, and supporting portions.

3-11. Additional Exemplary Embodiment 11

Furthermore, in the above-described exemplary embodiments cases are described in which the automatic teller machine 1, which serves as a sheet paper handling device, is formed by the distribution conveyor unit fixed guides 54 and the storage box path fixed guides 56, which serve as connection-side conveyor guides, the movable guides 58, which serve as conveyor guides, and the movable guide supporting portions 60, which serve as supporting portions. However, the present invention is not limited to this, and it is also possible to form the automatic teller machine 1 using connection-side conveyor guides, conveyor guides, and supporting portions having a variety of other structures.

Priority is claimed on Japanese Patent Application No. 2014-181524, the disclosure of which is incorporated herein in its entirety by reference.

All references, patent applications and technical specifications cited in the present specification are incorporated by reference into the present specification to the same extent as if the individual references, patent applications and technical specifications were specifically and individually recited as being incorporated by reference.

INDUSTRIAL APPLICABILITY

The present invention can be applied to sheet paper conveyor devices that convey sheet paper such as banknotes, vouchers, tickets, copy paper, postcards, and securities and the like, and to sheet paper handling devices that handle sheet paper such as banknotes, vouchers, tickets, copy paper, postcards, and securities and the like that are conveyed by a sheet paper conveyor device.

The invention claimed is:

1. A sheet paper conveyor device comprising:

a plurality of sheet paper conveyor units that are arranged in a first direction of a sheet paper conveyance path and are movable in the first direction and a second direction opposite to the first direction, each said sheet paper conveyor unit including a pair of conveyor guides that form a sheet paper conveyance path between guide surfaces which face each other with a predetermined conveyance path width between them and which are parallel to each other, and that have end portions in a conveyance direction of the sheet paper, the end portions being engageable with end portions of a pair of connection-side conveyor guides that form the sheet paper conveyance path using connection subject conveyance path guide surfaces that face each other with the conveyance path width between them and are parallel to each other, the pair of conveyor guides being formed as an integrated unit by combining a one surface conveyor guide that guides one surface of the sheet paper with another surface conveyor guide that guides another surface of the sheet paper; and a supporting portion that rotatably supports the pair of conveyor guides in accordance with a position of the pair of connection-side conveyor guides such that the conveyance path width is maintained and such that the guide surfaces are maintained to be parallel, wherein the pair of conveyor guides in each of the sheet paper conveyor units are configured to independently rotate.

2. The sheet paper conveyor device according to claim 1, wherein the pair of conveyor guides rotates around a shaft that is positioned between the one surface of the conveyor guide and the another surface of the conveyor guide, the shaft being substantially in a central portion of the sheet paper conveyor unit in the conveyance direction.

3. The sheet paper conveyor device according to claim 1, wherein one end portion of the pair of conveyor guides in the conveyance direction is engageable with one of the pair of the connection-side conveyor guides, while another end portion of the pair of conveyor guides in the conveyance direction is engageable with another one of the pair of the connection-side conveyor guides.

4. The sheet paper conveyor device according to claim 1, wherein the plurality of sheet paper conveyor units includes a first sheet paper conveyor unit and a second sheet paper conveyor unit, the sheet paper conveyor device further comprising a positioning unit that is configured to adjust a position of the first sheet paper conveyor unit to a position of the second sheet paper conveyor unit such that the position of the pair of conveyor guides matches the position of the connection-side conveyor guides in the first and second sheet conveyor units in the first direction and in the second direction.

5. The sheet paper conveyor device according to claim 4, wherein, when a predetermined force or greater is applied in the first direction or in the second direction to the second sheet paper conveyor unit once the second sheet paper conveyor has been correctly positioned relative to the first sheet paper conveyor unit, the positioning unit allows the second sheet paper conveyor unit to slide relative to the first sheet paper conveyor unit.

6. The sheet paper conveyor device according to claim 5, wherein each of the first and second sheet paper conveyor units further includes positioning components and recesses, the positioning components of the first sheet paper conveyor unit being urged towards the second sheet paper conveyor unit, each of the recesses of the first sheet paper conveyor unit being formed in an area such that each said recess of the first sheet paper conveyor unit is engaged with a corresponding one of the position components of the second sheet paper conveyor unit.

7. The sheet paper conveyor device according to claim 6, wherein, the positioning components include rollers, each of which fits an inside of a corresponding one of the recesses, the rollers of the first sheet paper conveyor unit are able to rotate and are also able to move in a direction from the second sheet paper conveyor unit toward the first sheet paper conveyor unit.

8. The sheet paper conveyor device according to claim 6, wherein, the positioning components include projections, each of which fits an inside of a corresponding one of the recesses, the rollers of the first sheet paper conveyor unit are able to move in a direction from the second sheet paper conveyor unit toward the first sheet paper conveyor unit.

9. The sheet paper conveyor device according to claim 5, wherein, the first sheet paper conveyor unit further includes a first magnet, and the second sheet paper conveyor unit further includes a second magnet, and the second magnet of the second sheet paper conveyor unit is arranged so as to attract the first magnet of the first sheet paper conveyor unit.

10. The sheet paper conveyor device according to claim 1, wherein the supporting portion supports the pair of conveyor guides such that the pair of conveyor guides is able to move in the first direction and in the second direction in accordance with the position of the pair of connection-side conveyor guides.

11. A sheet paper handling device comprising:

a plurality of sheet paper conveyor units that are arranged in a first direction of a sheet paper conveyance path and are movable in the first direction and a second direction opposite to the first direction, each said sheet paper conveyor unit including a pair of connection-side conveyor guides that form a sheet paper conveyance path using connection subject conveyance path guide surfaces that face each other with a predetermined conveyance path width between them and are parallel to each other;

a pair of conveyor guides that form the sheet paper conveyance path between guide surfaces which face each other with the conveyance path width between them and which are parallel to each other, and that have end portions in a conveyance direction of the sheet paper, the end portions being engaged with end portions of the pair of connection-side conveyor guides, the pair of conveyor guides being formed as an integrated unit by combining a one surface conveyor guide that guides one surface of the sheet paper with another surface conveyor guide that guides another surface of the sheet paper; and a supporting portion that rotatably supports the pair of conveyor guides in accordance with a position of the pair of connection-side conveyor guides such that the conveyance path width is maintained and such that the guide surfaces is maintained to be parallel, wherein the pair of conveyor guides in each of the sheet paper conveyor units are configured to independently rotate.

* * * * *